US011780244B2

(12) United States Patent
Hase et al.

(10) Patent No.: US 11,780,244 B2
(45) Date of Patent: Oct. 10, 2023

(54) HEATING DEVICE, LIQUID APPLYING APPARATUS, IMAGE FORMING APPARATUS, POST-PROCESSING APPARATUS, AND CONVEYING DEVICE

(71) Applicants: Takamasa Hase, Tokyo (JP); Takashi Seto, Kanagawa (JP)

(72) Inventors: Takamasa Hase, Tokyo (JP); Takashi Seto, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/129,964

(22) Filed: Dec. 22, 2020

(65) Prior Publication Data

US 2021/0197585 A1 Jul. 1, 2021

(30) Foreign Application Priority Data

Dec. 26, 2019 (JP) ..... 2019-236154

(51) Int. Cl.
*B41J 11/00* (2006.01)
*B41J 11/04* (2006.01)

(52) U.S. Cl.
CPC ..... *B41J 11/00242* (2021.01); *B41J 11/04* (2013.01)

(58) Field of Classification Search
None
See application file for complete search history.

(56) References Cited

U.S. PATENT DOCUMENTS

2002/0051665 A1 5/2002 Seto et al.
2005/0002054 A1 1/2005 Shoji et al.
2010/0014903 A1 1/2010 Seto et al.
2011/0217091 A1 9/2011 Hirose et al.
2011/0267393 A1* 11/2011 Okamoto ..... B41J 11/0024 347/61
2011/0305491 A1 12/2011 Hasegawa et al.
2015/0346659 A1* 12/2015 Nagayama ..... G03G 15/2039 101/424.1
2016/0101635 A1 4/2016 Hoshino et al.
2016/0167403 A1* 6/2016 Toya ..... F26B 13/18 34/442
2018/0056673 A1* 3/2018 Suzuki ..... B41J 29/12
2018/0339528 A1* 11/2018 Ueda ..... B41J 11/0045

FOREIGN PATENT DOCUMENTS

EP 2551118 A2 * 1/2013 ..... B41J 11/002
JP 2007076060 A * 3/2007
JP 2016-078428 5/2016

* cited by examiner

*Primary Examiner* — Justin Seo
*Assistant Examiner* — Tracey M McMillion
(74) *Attorney, Agent, or Firm* — XSENSUS LLP

(57) ABSTRACT

A heating device includes a first heat member and a second heat member. The first heat member is configured to heat a sheet on a liquid applied face. The second heat member is configured to heat the sheet on an opposite face opposite the liquid applied face of the sheet. A temperature of the second heat member to heat the sheet is higher than a temperature of the first heat member to heat the sheet.

19 Claims, 18 Drawing Sheets

HEATING DEVICE, LIQUID APPLYING APPARATUS, IMAGE FORMING APPARATUS, POST-PROCESSING APPARATUS, AND CONVEYING DEVICE

CROSS-REFERENCE TO RELATED APPLICATION

This patent application is based on and claims priority pursuant to 35 U.S.C. § 119(a) to Japanese Patent Application No. 2019-236154, filed on Dec. 26, 2019, in the Japan Patent Office, the entire disclosure of which is hereby incorporated by reference herein.

BACKGROUND

Technical Field

Embodiments of the present disclosure relate to a heating device, a liquid applying apparatus, an image forming apparatus, a post-processing apparatus, and a conveying device.

Background Art

Various types of drying devices, each of which are provided as a heating device in an image forming apparatus such as a copier and a printer, are known to heat a sheet to dry liquid on the sheet.

For example, even if cockling (waving) occurs to a sheet when liquid is applied to the sheet, a known drying device eliminates the cockling and causes the sheet to closely contact a heat roller to dry the sheet efficiently.

SUMMARY

At least one aspect of this disclosure, a novel heating device includes a first heat member and a second heat member. The first heat is configured to heat a sheet on a liquid applied face. The second heat member is configured to heat the sheet on an opposite face opposite the liquid applied face of the sheet. A temperature of the second heat member to heat the sheet is higher than a temperature higher than a temperature of the first heat member to heat the sheet.

Further, at least one aspect of this disclosure, a liquid applying apparatus includes a liquid applier configured to apply a liquid to a sheet, and the above-described heating device.

Further, at least one aspect of this disclosure, an image forming apparatus includes an image forming device configured to form an image on a sheet with liquid, and the above-described heating device.

Further, at least one aspect of this disclosure, a post-processing apparatus includes the above-described heating device and a post-processing device configured to perform a post-processing operation to a sheet that has passed the heating device.

Further, at least one aspect of this disclosure, a conveying device includes the above-described heating device and a conveyance passage configured to convey a sheet that has passed the heating device, to a post-processing device to perform a post-processing operation to the sheet.

BRIEF DESCRIPTION OF THE SEVERAL VIEWS OF THE DRAWINGS

Exemplary embodiments of this disclosure will be described in detail based on the following figures, wherein.

Figure 1:
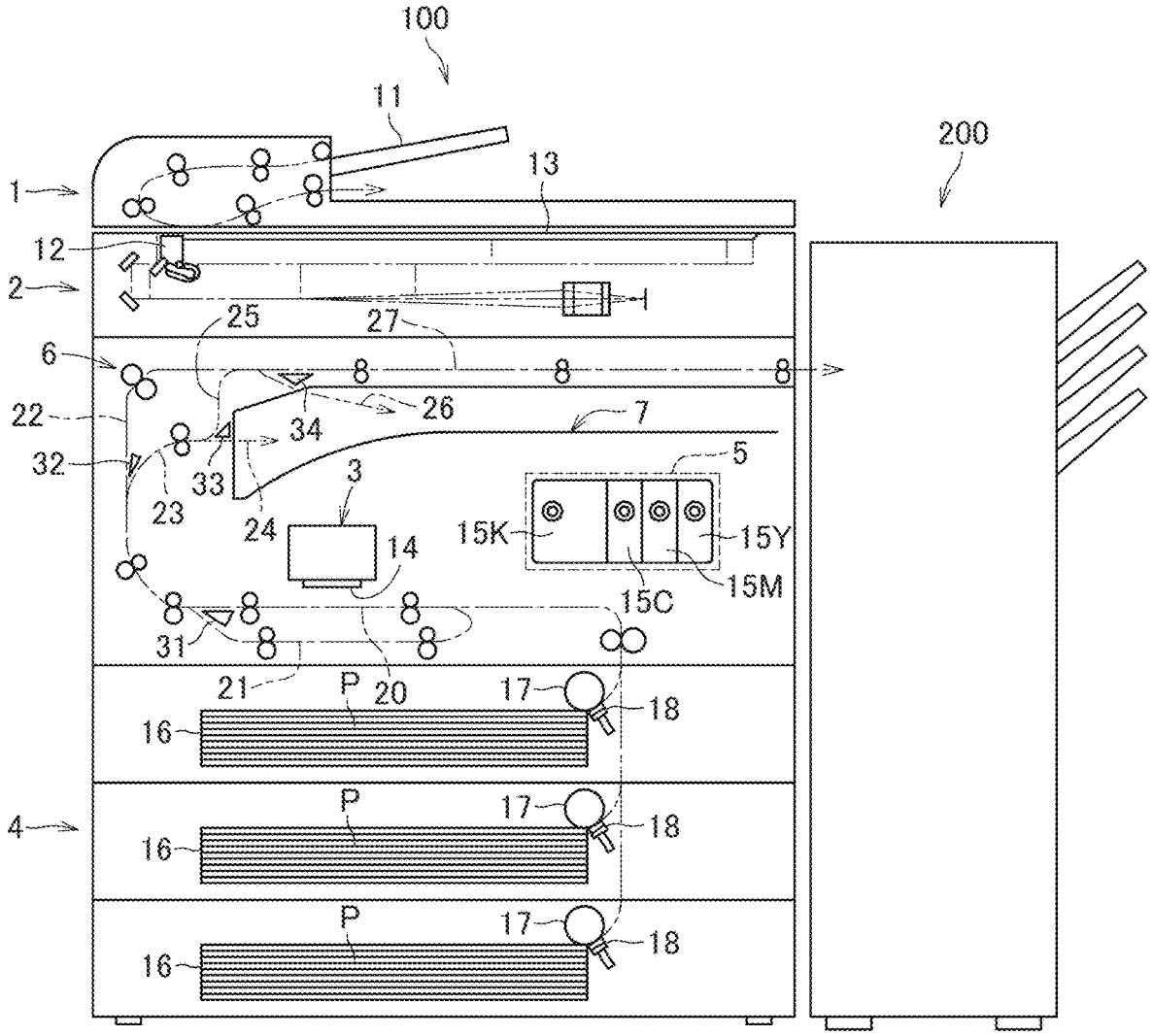
FIG. 1 is a diagram illustrating a schematic configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

It will be understood that if an element or layer is referred to as being "on," "against." "connected to" or "coupled to" another element or layer, then it can be directly on, against, connected or coupled to the other element or layer, or intervening elements or layers may be present. In contrast, if an element is referred to as being "directly on," "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath," "below," "lower," "above," "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

The terminology used herein is for describing particular embodiments and examples and is not intended to be limiting of exemplary embodiments of this disclosure. As used herein, the singular forms "a," "an," and "the" are intended to include the plural forms as well, unless the context clearly indicates otherwise. It will be further understood that the terms "includes" and/or "including," when used in this specification, specify the presence of stated features, integers, steps, operations, elements, and/or components, but do not preclude the presence or addition of one or more other features, integers, steps, operations, elements, components, and/or groups thereof.

Referring now to the drawings, embodiments of the present disclosure are described below. In the drawings for explaining the following embodiments, the same reference codes are allocated to elements (members or components) having the same function or shape and redundant descriptions thereof are omitted below.

Descriptions are given of an example applicable to a drying device, a liquid applying apparatus, an image forming apparatus, a post-processing apparatus, and a conveying device. It is to be noted that elements (for example, mechanical parts and components) having the same functions and shapes are denoted by the same reference numerals throughout the specification and redundant descriptions are omitted.

FIG. 1 is a diagram illustrating a schematic configuration of an image forming apparatus according to an embodiment of the present disclosure.

As illustrated in FIG. 1, an image forming apparatus 100 according to the present embodiment includes an original document conveying device 1, an image reading device 2, an image forming device 3, a sheet feeding device 4, a cartridge container 5, a drying device (heating device) 6, and a sheet ejection portion 7. Further, a sheet alignment apparatus 200 is disposed adjacent to the image forming apparatus 100.

The original document conveying device 1 separates an original document from the other original documents one by one from a set of original documents on an original document tray 11 and conveys the separated original document toward an exposure glass 13 of the image reading device 2. The original document conveying device 1 includes a plurality of conveyance rollers each functioning as an original document conveyor to convey the original document.

The image reading device 2 is an image scanner, that is, a device to scan the image on an original document placed on the exposure glass 13 or the image on an original document as the original document passes over the exposure glass 13. The image reading device 2 includes an optical scanning unit 12 as an image reading unit. The optical scanning unit 12 includes a light source that irradiates an original document placed on the exposure glass 13 with light, and a charge-coupled device (CCD) as an image reader that reads an image from the reflected light of the original document. Further, a close contact-type image sensor (CIS) may be employed as an image reader.

The image forming device 3 includes a liquid discharge head 14 that functions as a liquid discharger to discharge ink that is liquid used for image formation. The liquid discharge head 14 may be a serial-type liquid discharge head that discharges ink while moving in the main scanning direction of a sheet (i.e., the sheet width direction) or a line-type liquid discharge head that discharges ink without moving a plurality of liquid discharge heads aligned in the main scanning direction.

Ink cartridges 15Y, 15M, 15C, and 15K are detachably attached to the cartridge container 5. The ink cartridges 15Y, 15M. 15C, and 15K are filled with inks of different colors such as yellow, magenta, cyan, and black, respectively. The ink in each ink cartridge (i.e., the ink cartridges 15Y, 15M, 15C, 15K) is supplied to the liquid discharge head 14 by an ink supply pump.

The sheet feeding device 4 includes a plurality of sheet feed trays 16 each functioning as a sheet container. Each sheet feed tray 16 loads a bundle of sheets including a sheet P. Each sheet P on which an image is formed is a cut sheet cut in a predetermined size, e.g., A4 size and B4 size, and is previously contained in the sheet feed tray 16 in a corresponding sheet conveyance direction. Further, each sheet feed tray 16 includes a sheet feed roller 17 that functions as a sheet feeder and a sheet separation pad 18 that functions as a sheet separator.

The sheet alignment apparatus 200 functions as a post-processing apparatus to align and register the sheets P conveyed from the image forming apparatus 100. Further, in addition to the sheet alignment apparatus 200, another post-processing apparatus such as a stapling device that staples (binds) the sheets and a punching device that punches holes in the sheet may be installed.

To provide a fuller understanding of the embodiments of the present disclosure, a description is now given of the image forming operation of the image forming apparatus 100 according to the present embodiment of this disclosure, with continued reference to FIG. 1.

As an instruction is given to start the printing operation, the sheet P is fed from one sheet feed tray 16 of the plurality of sheet feed trays 16. To be more specific, as the sheet feed roller 17 rotates, the uppermost sheet P placed on top of the bundle of sheets P contained in the sheet feed tray 16 is fed by the sheet feed roller 17 and the sheet separation pad 18 while the uppermost sheet P is separated from the other sheets of the bundle of sheets.

When the sheet P is conveyed to a sheet conveyance passage 20 that extends in the horizontal direction and faces the image forming device 3, the image forming device 3 forms an image on the sheet P. To be more specific, the liquid discharge head 14 is controlled to discharge liquid (ink) according to image data of the original document read by the image reading device 2 or print data instructed to print by an external device, so that ink is discharged on the image forming surface (upper face) of the sheet P to form an image. Note that the image to be formed on the sheet P may be a meaningful image such as text or a figure, or a pattern having no meaning per se.

When a duplex printing is performed, the sheet P is conveyed in the opposite direction opposite the sheet conveyance direction at a position downstream from the image forming device 3 in the sheet conveyance direction, so that the sheet P is guided to a sheet reverse passage 21. To be more specific, after the trailing end of the sheet P has passed a first passage changer 31 that is disposed downstream from the image forming device 3 in the sheet conveyance direction, the sheet P is conveyed in the opposite direction. Further, after the trailing end of the sheet P has passed the first passage changer 31, the first passage changer 31 changes the sheet conveyance passage of the sheet P to the sheet reverse passage 21. Accordingly, the sheet P is guided to the sheet reverse passage 21. Then, as the sheet P passes through the sheet reverse passage 21, the sheet P is reversed upside down and conveyed to the image forming device 3 again. Then, the image forming device 3 repeats the same operation performed to the front face of the sheet P, so as to form an image on the back face of the sheet P.

A second passage changer 32 is disposed downstream from the first passage changer 31 in the sheet conveyance direction. The second passage changer 32 guides the sheet P with the image selectively to a sheet conveyance passage 22 that runs through the drying device 6 or to a sheet conveyance passage 23 that does not run through the drying device 6. When the sheet P is guided to the sheet conveyance passage 22 through which the sheet P passes the drying device 6, the drying device 6 dries the ink on the sheet P. On the other hand, when the sheet P is guided to the sheet conveyance passage 23 through which the sheet P does not pass the drying device 6, a third passage changer 33 guides the sheet P selectively to a sheet conveyance passage 24 toward the sheet ejection portion 7 or to a sheet conveyance passage 25 toward the sheet alignment apparatus 200. Further, after the sheet P has passed the drying device 6, a fourth passage changer 34 guides the sheet P selectively to a sheet conveyance passage 26 toward the sheet ejection portion 7 or to a sheet conveyance passage 27 toward the sheet alignment apparatus 200.

In a case in which the sheet P is guided to the sheet conveyance passage 24 or the sheet conveyance passage 26 toward the sheet ejection portion 7, the sheet P is ejected to the sheet ejection portion 7 with a liquid applied face of the sheet P down. On the other hand, in a case in which the sheet P is guided to the sheet conveyance passage 25 or the sheet conveyance passage 27 toward the sheet alignment apparatus 200, the sheet P is conveyed to the sheet alignment apparatus 200, so that the bundle of sheets P is aligned and stacked. Accordingly, a series of printing operations is completed.

Next, a description is given of the configuration of the drying device 6 according to the present embodiment.

Figure 2:
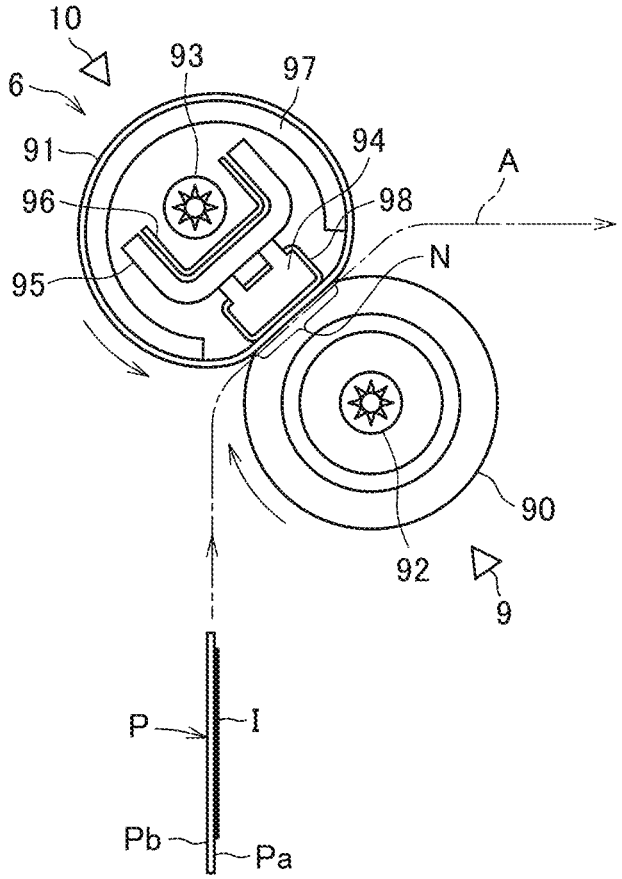
FIG. 2 is a diagram illustrating a schematic configuration of a drying device provided in the image forming apparatus of FIG. 1, according to an embodiment of the present disclosure.

FIG. 2 is a diagram illustrating a schematic configuration of a drying device provided in the image forming apparatus of FIG. 1, according to an embodiment of the present disclosure. As illustrated in FIG. 2, the drying device 6 includes a heat roller 90, a heat belt 91, two heaters 92 and 93, a nip formation pad 94, a stay 95, a reflector 96, and a belt support 97.

The heat roller 90 functions as a first heating member that heats a sheet P and is a cylindrical heat rotator. In the present embodiment, the heat roller 90 has an iron core metal, an elastic layer formed on the surface of the core metal, and a release layer formed on the outside of the elastic layer. The elastic layer is made of silicone rubber and has a thickness of 3.5 mm, for example. The elastic layer of the heat roller 90 may be made of solid rubber. Alternatively, if no heater is disposed inside the heat roller 90, the elastic layer of the heat roller 90 may be made of sponge rubber. The release layer is made of fluororesin, for example, tetrafluoroethylene-perfluoroalkyl vinyl ether copolymer (PFA) or polytetrafluoroethylene (PTFE) and has a thickness of 40 μm, for example.

The heat belt 91 functions as a second heating member that heats a sheet P and is a cylindrical heat rotator radially thinner than the heat roller 90. In the present embodiment, the heat belt 91 is an endless (cylindrical) belt having a flexibility. The heat belt 91 may be, for example, a film. The heat belt 91 has a cylindrical base layer made of polyimide (PI). The base layer of the heat belt 91 has a thickness in a range of from 40 μm to 120 μm, for example. Further, the base layer of the heat belt 91 is not limited to polyimide (PI). Alternatively, the base layer of the heat belt 91 may be made of heat resistant resin such as polyether ether ketone (PEEK), or metal such as nickel (Ni) or steel use stainless (SUS). Further, the release layer may be provided on the extreme outer layer (top layer) of the heat belt 91. The release layer is made of fluororesin, for example, PFA or PTFE and has a thickness of 5 μm to 50 μm, for example.

Of the two heaters 92 and 93, the heater 92 is disposed inside the heat roller 90 and the heater 93 is disposed inside the heat belt 91. In the present embodiment, the heaters 92 and 93 each employs a halogen heater. The infrared light emitted from the heaters 92 and 93 directly irradiates the inner circumferential surface of the heat roller 90 and the inner circumferential surface of the heat belt 91. Accordingly, the heat roller 90 and the heat belt 91 are heated. As a heat source to heat the heat roller 90 and the heat belt 91, a radiation-type heater, e.g., a halogen heater and a carbon heater, to emit infrared ray, an electromagnetic induction-type heat source, and a warm air generation device may be employed. Further, the heater may be a contact-type heater or a non-contact type heater.

The nip formation pad 94 sandwiches the heat belt 91 together with the heat roller 90, thereby forming the fixing nip region N. The nip formation pad 94 is provided inside the heat belt 91, longitudinally along a rotational axis direction of the heat belt 91. In the drying device 6 according to the present embodiment, since the heat roller 90 is biased toward the nip formation pad 94 by a pressing member such as a spring and a cam, the heat roller 90 is pressed against the nip formation pad 94 via the heat belt 91. Accordingly, the nip region N is formed in the portion in which the heat roller 90 and the heat belt 91 are pressed against each other. The nip formation pad 94 is preferably made of a heat-resistant resin material in order to prevent deformation due to heat and to form the nip region N having the stability.

In the present embodiment, in order to improve the slidability of the heat belt 91 with respect to the nip formation pad 94, a sheet-like sliding member (sliding sheet) 98 made of a low friction material such as PTFE is provided between the nip formation pad 94 and the heat belt 91. Further, in a case in which the nip formation pad 94 is made of a low friction material having slidability, the nip formation pad 94 may come into direct contact with the heat belt 91 without interposing the sliding member 98.

The stay 95 is a support that supports the nip formation pad 94 against the pressing force of the heat roller 90. Here, when the stay 95 "supports" the nip formation pad 94, the stay 95 contacts the nip formation pad 94 on the side opposite the heat roller 90 so as to restrain the bending (warping) of the nip formation pad 94 due to the pressing force of the heat roller 90, in particular, the bending of the nip formation pad 94 in the pressing direction of the heat roller 90 over the longitudinal direction of the nip formation pad 94. Since the stay 95 supports the nip formation pad 94, the bending of the nip formation pad 94 is restrained, thereby forming the nip region N having the uniform width. Further, the stay 95 is preferably made of metal material such as SUS or SECC in order to have the good rigidity.

The reflector 96 reflects heat and light radiated from the heater. The reflector 96 is interposed between the heater 93 and stay 95 in the loop of the heat belt 91. Since the reflector 96 reflects the heat and light radiated from the heater 93 on the heat belt 91, the reflector 96 restrains conduction of radiation heat to the stay 95. Therefore, the heat belt 91 is effectively heated, thereby achieving energy saving. The reflector 96 is made of, e.g., aluminum or stainless steel.

The belt support 97 is a C-shaped or cylindrical member that supports the heat belt 91 from the inside. The belt support 97 is provided inside the heat belt 91, at both ends of the heat belt 91 in the rotational axis direction. With this configuration, the belt support 97 rotatably supports the heat belt 91. Further, in the stationary state in which the heat belt 91 is not rotating, the heat belt 91 is basically supported in a state in a state in which the tension is not generated in the circumferential direction of the heat belt 91.

Next, a description is given of the operations of the drying device 6.

As the print job starts, the heat roller 90 rotates in a direction indicated by arrow in FIG. 2 (that is, a clockwise direction). By so doing, the heat belt 91 is rotated together with the rotation of the heat roller 90. Further, the heaters 92 and 93 start to generate heat, so that the heat roller 90 and the heat belt 91 are heated.

In the state in which the temperature of the heat roller 90 and the temperature of the heat belt 91 have reached respective target temperatures, the sheet P to which the liquid ink I is attached is conveyed to the drying device 6, as illustrated in FIG. 2. As illustrated in FIG. 2, for example, the temperature of the heat roller 90 is detected by a temperature detector 9 that detects the surface temperature of the heat roller 90 and the temperature of the heat belt 91 is detected by a temperature detector 10 that detects the surface temperature of the heat belt 91. Note that the temperature detection method of detecting the temperatures of the heat roller 90 and the heat belt 91 is not limited to the above-described temperature detection method. For example, the heat generation amounts of the heaters 92 and 93 may be detected or temperature near the nip start position of the heat roller 90 and the heat belt 91 (e.g., the entrance side of the sheet P to the nip region N) may be detected. However, the surface temperature of the heat belt 91 is controlled to be higher than the surface temperature of the heat roller 90. Then, the sheet P enters the nip region N between the heat roller 90 and the heat belt 91, so that the sheet P is conveyed by the heat roller 90 and the heat belt 91 while the heat roller 90 and the heat belt 91 are rotating. At this time, the sheet P is heated and pressed between the heat roller 90 and the heat belt 91. This heating of the sheet P dries the ink I on the sheet P. Then, the sheet P is ejected from the drying device 6 by the heat roller 90 and the heat belt 91 that are rotating.

In a liquid discharge-type image forming apparatus that discharges liquid onto the sheet and forms an image on the sheet, application of liquid to the sheet may cause curling on the sheet.

Figure 3:
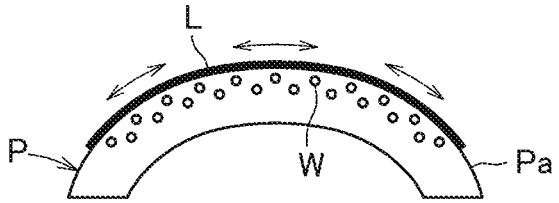
FIG. 3 is a diagram for explaining the principle of generation of a back curl on a sheet.

FIG. 3 is a diagram for explaining the principle of generation of a back curl on a sheet.

Figure 4:
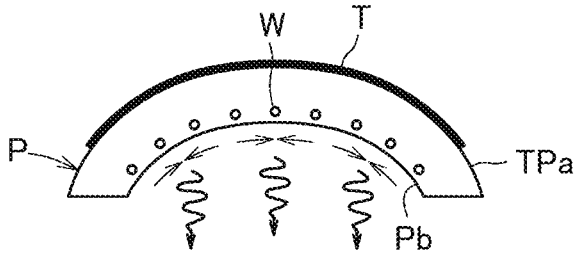
FIG. 4 is a diagram for explaining the principle of generation of another back curl on a sheet.

FIG. 4 is a diagram for explaining the principle of generation of another back curl on a sheet.

Generally, in a case of a plain paper, when liquid L such as ink is applied to one side, that is, the liquid applied face Pa of the sheet P illustrated in FIG. 3, water W in the liquid L stretches fabric on the liquid applied face Pa of the sheet P in a specified direction, which generates a curl. More specifically, the water W permeates between the cellulose fibers of the sheet P and breaks the hydrogen bond of the cellulose fibers. By so doing, the intervals of the cellulose fibers increase, and therefore the sheet P extends in the specified direction. As a result, the sheet P warps upward to cause the liquid applied face Pa (image forming surface) to have a curl in a convex shape. The curl is referred to as a back curl.

Further, in an electrophotographic image forming apparatus that forms an image with toner, the toner applied face of the sheet is heated at the temperature higher than the temperature of the opposite face that is opposite the toner applied face of the sheet to fix the toner to the sheet. This heating may result in generation of a curl that is similar to the back curl. FIG. 4 is a diagram for explaining the principle of generation of another back curl on a sheet P. That is, as illustrated in FIG. 4, when the toner adhesion face TPa of the sheet P, on which toner T adheres, is heated with the high temperature, the water content of the water W originally contained in the sheet P is higher on the opposite face Pb than on the toner adhesion face TPa. Therefore, the shrinkage of the sheet P caused by the subsequent drying is more remarkable on the opposite face Pb than on the toner adhesion face TPa. As a result, this shrinkage causes the toner adhesion face TPa (image forming surface) of the sheet P to warp upward in a convex shape to generate a back curl.

Generation of such a back curl on the sheet may cause inconveniences such as a conveyance failure by the sheet being caught in the middle of conveyance and an inconvenience to decrease the number of sheets stackable in the sheet ejection tray. Therefore, an embodiment of the present disclosure provides countermeasures to effectively restrain deformation of sheet such as back curl.

Hereinafter, a detailed description is given of the configuration to effectively restrain deformation of sheet in an embodiment of the present disclosure.

In the drying apparatus 6 according to the above-described embodiment, when the sheet P passes between the heat roller 90 and the heat belt 91, the surface temperature (temperature of the outer circumferential surface) of the heat roller 90 is referred to as a surface temperature t1 and the surface temperature (temperature of the outer circumferential surface) of the heat belt 91 is referred to as a surface temperature t2. In this case, the surface temperature t2 of the heat belt 91 is controlled to be higher than the surface temperature t1 of the heat roller 90.

Therefore, as the sheet P is conveyed to the drying device 6 as illustrated in FIG. 2, the opposite face Pb that is opposite the liquid applied face Pa of the sheet P contacts the heat belt 91 that has the higher surface temperature, and therefore the opposite face Pb of the sheet P is heated at the temperature higher than the liquid applied face Pa of the sheet P. That is, on the contrary to the example illustrated in FIG. 4 with a back curl, the opposite face of the sheet P is heated at the temperature higher than the image forming face of the sheet P in the drying device 6 according to the present embodiment. By so doing, a force is exerted in the opposite direction opposite the direction to which a force is applied to the sheet P to generate the back curl. As described above, in the drying device 6 according to the present embodiment, the opposite face Pb that is opposite the liquid applied face Pa is heated at the temperature higher than the liquid applied face Pa of the sheet P. By so doing, the force is generated in the opposite direction to the force to generate the back curl, thereby restraining generation of the subsequent back curl.

Further, when a duplex printing is performed, it is preferable to dry the image on the front face of a sheet and the image on the back face of the sheet separately. That is, after the drying device 6 has dried the image on the front face of the sheet P as described above, the sheet P is switched back and conveyed in the sheet conveyance passage 25 and the sheet conveyance passage 23. Then, the sheet P is guided to the image forming device 3 via the sheet reverse passage 21. Further, the sheet P may not be conveyed in the sheet conveyance passage 25 and the sheet conveyance passage 23, but may be conveyed toward upstream from the sheet conveyance passage 22 (upstream from the drying device 6) in the sheet conveyance direction via a different sheet conveyance passage that detours the drying device 6 and may be guided to the image forming device 3 via the sheet reverse passage 21. Then, after the image forming device 3 has formed an image on the back face of the sheet P, the sheet P is conveyed to the drying device 6 again to cause the drying device 6 to perform the drying process on the image on the back face of the sheet P.

When drying the image on the back face of the sheet P, the front face of the sheet P, which is opposite the back face of the sheet P, is heated by contacting the heat belt 91 having the high temperature. Therefore, the sheet P is heated at the high temperature from the opposite face Pb (front face) opposite the liquid applied face Pa (back face) on which ink is applied before the drying process, and therefore the force is exerted in the opposite direction to the direction of the force that generates a back curl to the sheet P. Also, when drying the image formed on the back face of the sheet P, the sheet P is heated from the opposite face Pb that is opposite the liquid applied face Pa at the higher temperature. By so doing, the back curl of the sheet P is restrained effectively.

Note that, since ink is applied to the front and back faces of the sheet P during the duplex printing, both the front and back faces of the sheet P may be referred to as liquid applied faces. In the present disclosure, however, when drying the ink on the back face of the sheet P after the duplex printing, the back face of the sheet P with ink before the drying process is referred to as the "liquid applied face." Therefore, the "liquid applied face" referred to in the description of the present disclosure represents the face on which liquid is applied (front face) when the sheet P has the liquid on a single face or the face on which liquid is applied for the second time (back face) when the sheet P has the liquid on both the front and back faces.

As described above, the drying device 6 according to the present embodiment heats the sheet P from the opposite face Pb that is opposite the liquid applied face Pa at the high temperature, thereby effectively restraining generation of the back curl. Therefore, when compared with a known drying device, the drying device 6 according to the present embodiment hardly causes inconveniences such as a conveyance failure by the sheet having a back curl and a decrease in the number of sheets stackable in the sheet ejection tray.

Further, in the drying device 6 according to the present embodiment, the sheet P is conveyed while being pressed between the heat roller 90 and the heat belt 91. By so doing, the heat is applied to the sheet P easily. Accordingly, the drying of ink on the sheet P is accelerated, and occurrence of application of ink to the sheet conveying roller and other sheets is reduced.

By contrast, immediately after the sheet P is conveyed to the drying device 6, it is highly likely that ink is still in a form of liquid. Therefore, if the sheet P having a particularly large amount of ink application enters between the heat roller 90 and the heat belt 91, the ink may adhere to the heat roller 90 that comes into contact with the liquid applied face Pa. In order to restrain ink application to the heat roller 90, a roller having the uneven portions, in other words, having convex and concave portions on the outer circumferential surface may be employed as the heat roller 90.

Figure 5:
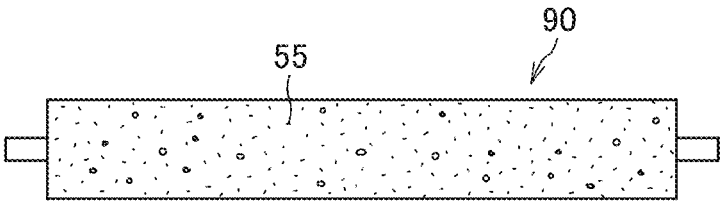
FIG. 5 is a diagram illustrating an example in which an abrasive roller is used as a heat roller.

FIG. 5 is a diagram illustrating an example in which an abrasive roller is used as a heat roller.

Figure 6:
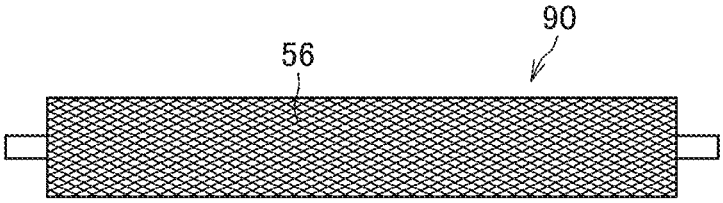
FIG. 6 is a diagram illustrating an example in which a knurled roller is used as a heat roller.

FIG. 6 is a diagram illustrating an example in which a knurled roller is used as a heat roller.

For example, the heat roller 43 may employ an abrasive roller having the outer circumferential surface on which abrasive grains 55 such as a plurality of ceramic or glass are attached, as illustrated in FIG. 5. Alternatively, the heat roller 43 may employ a knurl roller having the outer circumferential surface on which meshed convex-concave portions (knurling) 56 are provided, as illustrated in FIG. 6. Such a roller having uneven outer circumferential surface, in other words, having asperities on the outer circumferential surface, reduces the contact area of the heat roller 90 contacting the liquid applied face Pa of the sheet P, the application of ink to the heat roller 90 is further restrained. Accordingly, distortion of ink (image) due to contact of the heat roller 90 to the liquid applied face Pa of the sheet P and smear on the sheet P due to ink application from the heat roller 90 to another sheet are reduced effectively.

Further, in order to enhance the energy-saving performance, at least one of the temperature of the heat roller 90 and the temperature of the heat belt 91 may be controlled (adjustable) according to the amount of ink application to the sheet P. That is, in a case in which the amount of ink application to the sheet P is relatively small, the time to heat the sheet P for drying may be shorter when compared with a case in which the amount of ink application to the sheet P is relatively large. Therefore, the amount of heat generation of at least one of the heater 92 of the heat roller 90 and the heater 93 of the heat belt 91 is reduced. Accordingly, the energy-saving performance is enhanced.

Further, when the amount of liquid application to the sheet P is relatively small, the amount of generation of the back curl is also relatively small, when compared with a case in which the amount of liquid application to the sheet P is relatively large. Therefore, the temperature of the heat roller 90 and the temperature of the heat belt 91 may be relatively close to each other to reduce the difference between the temperature of the heat roller 90 and the temperature of the heat belt 91. In other words, the difference between the temperature of the heat roller 90 and the temperature of the heat belt 91 is smaller with a smaller amount of ink application to the sheet P than with a larger amount of ink application to the sheet P. Alternatively, when the amount of liquid application is equal to or smaller than the predetermined amount of liquid application, the difference between the temperature of the heat roller 90 and the temperature of the heat belt 91 may be controlled to be equal to or smaller than the predetermined temperature. Accordingly, when the amount of generation of the back curl is relatively small, the sheet P is restrained from being too decurled to conversely generate the face curl. Further, when the temperature of the heat roller 90 and the temperature of the heat belt 91 are relatively close to each other, an increase in temperature of the heat roller 90 dries the liquid applied face Pa more effectively.

Next, a description is given of a drying device according to another embodiment of the present disclosure.

Figure 7:
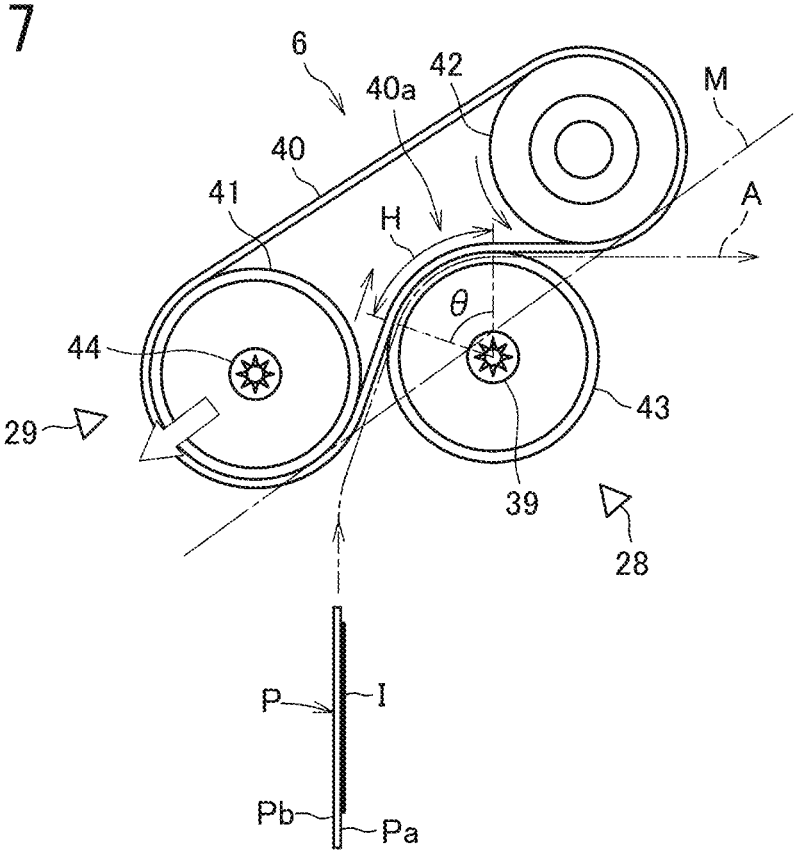
FIG. 7 is a diagram illustrating a configuration of the drying device according to another embodiment of the present disclosure.

FIG. 7 is a diagram illustrating the configuration of the drying device 6 according to another embodiment of the present disclosure.

As illustrated in FIG. 7, the drying device 6 according to the present embodiment includes a heat roller 43, a heat belt 40, two heaters 39 and 44, a tension roller 41, a fixed roller 42, and two temperature detectors 28 and 29.

The heat roller 43 is a first heating member that heats the sheet P and is a cylindrical heat rotator. Further, the heater 39 that functions as a heat source is disposed inside the heat roller 43. Further, the temperature detector 28 is disposed outside the heat roller 43 to detect the surface temperature of the heat roller 43, in other words, the temperature of the outer circumferential surface of the heat roller 43.

The heat belt 40 functions a second heating member that heats the sheet P and is an endless belt having the flexibility. The heat belt 40 is rotatably supported by the tension roller 41 and the fixed roller 42 while being wound around the tension roller 41 and the fixed roller 42. Further, the temperature detector 29 is disposed outside the heat belt 40 to detect the surface temperature of the heat belt 40, in other words, the temperature of the outer circumferential surface of the heat belt 40.

The tension roller 41 and the fixed roller 42 are belt supports each rotatably supporting the heat belt 40. The tension roller 41 is movable inside the loop of the heat belt 40 and is pressed against the inner circumferential surface of the heat belt 40 by a biasing member such as a spring. On the other hand, the fixed roller 42 is fixed so as not to move. Further, the heater 44 that functions as a heat source is disposed inside the tension roller 41. Therefore, as the heater 44 generates heat, the heat is transmitted to the heat belt 40 via the tension roller 41, so that the heat belt 40 is heated. Accordingly, the tension roller 41 in the present embodiment functions as a heating member (heat rotator) to heat the heat belt 40 with the heat generated by the heater 44 disposed inside the tension roller 41. Further, similar to the above-described embodiment, as a heat source that heats the heat roller 43 and the heat belt 40, a radiation-type heater, e.g., a halogen heater and a carbon heater, to emit infrared ray, an electromagnetic induction-type heat source, and a warm air generation device may be employed. Further, the heater may be a contact-type heater or a non-contact type heater.

In the drying device 6 according to the present embodiment, the heat roller 43 functions as a pressing member that presses the outer circumferential surface of the heat belt 40 between the tension roller 41 and the fixed roller 42 to form a curved portion 40*a*. That is, the heat roller 43 is pressed against the heat belt 40 by a pressing member such as a spring, toward the inside of the heat belt 40, in other words, toward the inside of the loop of the heat belt 40, from a common tangent line M that contacts the outer circumferential surface of the tension roller 41 and the outer circumferential surface of the fixed roller 42. By so doing, the heat belt 40 has a curved portion 40*a* that warps (curves) along the outer circumferential surface of the heat roller 43.

Next, a description is given of the operations of the drying device 6 illustrated in FIG. 7.

As the print job starts, the fixed roller 42 rotates in a direction indicated by arrow in FIG. 7 (that is, a counter-clockwise direction). By so doing, the heat belt 40, the tension roller 41, and the heat roller 43 are rotated together with the rotation of the fixed roller 42. Note that the tension roller 41 and the heat roller 43 each may be function as a drive roller. Further, the heater 39 generates heat to heat the heat roller 43 and the heater 44 generates heat to heat the heat belt 40. The heaters 39 and 44 are controlled to generate the heats of the heat roller 43 and the heat belt 40 to make the temperature of the heat belt 40 to be higher than the temperature of the heat roller 43.

In this state, as illustrated in FIG. 7, as the sheet P on which a liquid ink I is applied is conveyed to the drying device 6, the opposite face Pb that is opposite the liquid applied face Pa of the sheet P contacts the heat belt 40, so that the sheet P is conveyed by the heat belt 40 while the heat belt 40 is rotating and the sheet P is heated from the opposite face Pb of the sheet P. Then, as the sheet P enters the nip region formed between the heat roller 43 and the heat belt 40, the sheet P is conveyed by the heat belt 40 and the heat roller 43 while the heat belt 40 and the heat roller 43 are pressing the sheet P from both sides, i.e., the front and back faces of the sheet P. By so doing, the ink I on the sheet P is dried, and the sheet P is then ejected from the drying device 6.

In the drying device 6 according to the present embodiment, when the sheet P passes between the heat roller 43 and the heat belt 40, the temperature of the heat belt 40 is controlled to be higher than the temperature of the heat roller 43. Therefore, the opposite face Pb that is opposite the liquid applied face Pa is heated at a temperature higher than the temperature of the liquid applied face Pa of the sheet P. Accordingly, as the above-described embodiment, the force is exerted in the opposite direction opposite the direction of the force to generate a back curl on the sheet P, thereby restraining generation of the subsequent back curl.

Further, in the drying device 6 according to the present embodiment, when the sheet P passes the heat roller 43, the sheet P is conveyed along the curved portion 40*a* of the heat belt 40 while the liquid applied face Pa of the sheet P is warped in the concave shape over the sheet conveyance direction A. That is, the sheet P is conveyed while being warped in a direction opposite the curve direction of the back curl. Accordingly, the sheet P hardly warps in the curve direction of the back curl, thereby restraining generation of the subsequent back curl.

In addition, in the drying device 6 according to the present embodiment, the heat roller 43 presses the heat belt 40 inwardly between the tension roller 41 and the fixed roller 42. Therefore, the length H of the contact area of the heat roller 43 to the heat belt 40 (that is, the length of the nip region in the sheet conveyance direction A) is longer than the length of the contact area in the sheet conveyance direction A in the drying device 6 according to the above-described embodiment. Furthermore, since the sheet P is pressed against the heat belt 40 by the heat roller 43 with the outer circumferential surface having the cylindrical shape, the closeness (contact area) of the sheet P to the heat belt 40 increases. Therefore, the heat is effectively conducted from the heat belt 40 to the sheet P, and drying ink on the sheet P is further accelerated. As a result, the drying device 6 restrains generation of back curl more effectively.

As described above, the drying device 6 according to the present embodiment heats the sheet P at the temperature of the opposite face Pb of the sheet P higher than the temperature of the liquid applied face Pa of the sheet P and warps the sheet P in the curved portion 40*a*, thereby effectively restraining generation of the back curl. Therefore, the drying device 6 according to the present embodiment hardly causes inconveniences such as a conveyance failure by the sheet having a back curl and a decrease in the number of sheets stackable in the sheet ejection tray.

Further, the drying device 6 according to the present embodiment also restrains cockling (waving) of the sheet as well as back curl. That is, even when the sheet P having cockling is conveyed to the drying device 6 according to the present embodiment, the sheet P is conveyed while the heat roller 43 presses the sheet P. and the liquid applied face Pa of the sheet P and the opposite face Pb of the sheet P are corrected to have the same length, so that the cockling of the sheet P is restrained. As described above, the drying device 6 according to the present embodiment effectively restrains, and prevents if possible, deformation of a sheet including back curl and cockling.

Note that, when a duplex printing is performed, as the above-described embodiment, it is preferable to perform the drying process to the image on the front face of a sheet and the image on the back face of the sheet separately. That is, after the drying device 6 has dried the image on the front face of the sheet P, the sheet P is conveyed in a sheet conveyance passage that detours the drying device 6. Then, the direction of conveyance of the sheet P is switched back (changed) to the upstream side from the drying device 6 in the sheet conveyance direction. Then, the sheet P is guided to the image forming device 3 via the sheet reverse passage 21. After the image forming device 3 has formed an image on the back side of the sheet P, the sheet P is conveyed to the drying device 6 again to cause the drying device 6 to perform the drying process to the image on the back face of the sheet P.

Further, in the drying device 6 according to the present embodiment, the sheet P is not strongly pressed on the heat belt 40. Therefore, occurrence of wrinkles of the sheet P is restrained. That is, in the present embodiment, the heat roller 43 contacts the heat belt 40 at the position spaced away from the tension roller 41 and the fixed roller 42 in the sheet conveyance direction A. Therefore, a nip region in which the sheet P is held by two rollers (e.g., a nip region between the heat roller 43 and the tension roller 41 and a nip region between the heat roller 43 and the fixed roller 42) is not formed. Further, in the drying device 6 according to the present embodiment, the sheet P is not strongly pressed on the heat belt 40 by the two rollers, and therefore occurrence of wrinkles of the sheet P is restrained.

Further, since the heat roller 43 is disposed not to contact (press) the tension roller 41 and the fixed roller 42 via the heat belt 40, the load to be applied to the heat belt 40 when the heat roller 43 presses the heat belt 40 is also reduced. Accordingly, damage and abrasion to the heat belt 40 are restrained, and therefore the durability of the heat belt 40 is enhanced and the long service life of the heat belt 40 is achieved. Further, the rotational resistance of the heat belt 40 is reduced, and therefore the efficiency of rotation of the heat belt 40 increases and the driving energy is saved.

Further, in the drying device 6 according to the present embodiment, the heat belt 40 is disposed to extend upstream from the heat roller 43 in the sheet conveyance direction A. Therefore, the sheet P is brought to contact the heat belt 40 to heat the heat belt 40 before the sheet P reaches the heat roller 43. Accordingly, the drying of the ink on the sheet P is accelerated before the sheet P contacts the heat roller 43 and ink application to the heat roller 43 is restrained.

In addition, in the drying device 6 according to the present embodiment, the heater 44 is disposed upstream from the heat roller 43 (or the curved portion 40*a* in which the heat roller 43 contacts the heat belt 40) in the sheet conveyance direction A. Therefore, the sheet P is effectively heated on the upstream side from the heat roller 43 in the sheet conveyance direction A. Accordingly, the ink on the sheet P is dried effectively before the sheet P reaches the heat roller 43 and ink application to the heat roller 43 is restrained effectively. Further, the heat roller 43 may include an abrasive roller as the heat roller 43, as illustrated in FIG. 5, or a knurl roller as the heat roller 43, as illustrated in FIG. 6, may be employed in order to restrain ink application to the heat roller 43 effectively.

Further, in the drying device 6 according to the present embodiment, the sheet P is conveyed via the curved portion 40*a* between the heat roller 43 and the heat belt 40. Therefore, even when the sheet P has stiffness (high rigidity), the sheet P is easily warped to change the direction of conveyance of the sheet P. In particular, this configuration of the drying device 6 is effective to the configuration of the image forming apparatus for conveying the sheet from the vertical direction to the horizontal direction, such as the image forming apparatuses 100 illustrated in FIG. 1. Therefore, the drying device 6 according to the present embodiment is disposed near the sheet ejection port through which the sheet is ejected from the image forming apparatus, and the sheet is ejected reliably.

Further, similar to the above-described embodiment, in order to enhance the energy-saving performance, at least one of the temperature of the heat roller 43 and the temperature of the heat belt 40 may be controlled (adjustable) according to the amount of ink application to the sheet P in the present embodiment. Further, when the amount of liquid application to the sheet P is relatively small, the amount of generation of the back curl is also relatively small, when compared with a case in which the amount of liquid application to the sheet P is relatively large. Therefore, the temperature of the heat roller 43 and the temperature of the heat belt 40 may be relatively close to each other to reduce the difference between the temperature of the heat roller 43 and the temperature of the heat belt 40. In other words, the difference between the temperature of the heat roller 43 and the temperature of the heat belt 40 is smaller with a smaller amount of ink application to the sheet P than with a larger amount of ink application to the sheet P. Alternatively, when the amount of liquid application is equal to or smaller than the predetermined amount of liquid application, the difference between the temperature of the heat roller 43 and the temperature of the heat belt 40 may be controlled to be equal to or smaller than the predetermined temperature.

Next, a description is given of the results of verification tests when the drying process is performed to the sheet with the drying device having the same configuration as the drying device illustrated in FIG. 2 or FIG. 7.

In this test, after ten (10) sheets having various image area rates (liquid application rate) were dried sequentially, it was determined whether the sheets have curling. The image area rate (liquid application rate) is the rate of an area of a sheet on which ink was applied with respect to the whole area of one side of the sheet. For evaluating generation of curling, 100 sheets of recycled PPC paper manufactured by Oji Paper Co., Ltd. were bundled in a unit of 10 sheets, loaded on the humid control shelf, and left in the environment of a temperature of 25 degrees Celsius (° C.) and a humidity of 65% for one (1) day. In addition, for configuration of generation of curling, each sheet ejected from the drying device was placed on a flat plate and the height from the upper face of the flat plate to each of the four (4) corners of each sheet was measured. The results are presented in Table 1. Table 1 indicates the amount of curl in a position value when a back curl having the convex shape (projecting shape) is generated on the image forming surface of the sheet and, by contrast, the amount of curl in a negative value when a face curl having the concave shape (recessed shape) is generated on the image forming surface of the sheet.

Details of the configuration of each drying device of the examples of the present disclosure, the configuration of each drying device of the comparative examples, the set temperature, and the image area rate of a dried sheet are described in Table 1 below. In Examples 1 to 8 of the present disclosure, the temperature of the heat belt (i.e., the second heating member contacting the opposite face that is opposite the liquid applied face of a sheet) is set to be higher than the temperature of the heat roller (i.e., the first heating member contacting the liquid applied face of the sheet). By contrast to the examples of the present disclosure, in Comparative Examples 2 and 3, the temperature of the heat roller is set to be higher than the temperature of the heat belt. Further, in Comparative Example 4, the heat roller is set to have the same temperature as the heat belt. Further, in Comparative Example 1, no drying device is used.

TABLE 1

| | Configuration of Drying Device | Image Area Rate (Liquid Application Rate) [%] | Temperature of Heat Roller (° C.) | Temperature of Heat Belt (° C.) | Amount of Curl [mm] |
|---|---|---|---|---|---|
| Example 1 | FIG. 2 | 80 | 80 | 120 | 4 |
| Example 2 | FIG. 2 | 60 | 85 | 115 | 3 |
| Example 3 | FIG. 2 | 40 | 90 | 110 | 2 |
| Example 4 | FIG. 2 | 20 | 95 | 105 | 1 |
| Example 5 | FIG. 7 | 80 | 80 | 120 | −2 |
| Example 6 | FIG. 7 | 60 | 85 | 115 | −2 |
| Example 7 | FIG. 7 | 40 | 90 | 110 | −1 |
| Example 8 | FIG. 7 | 20 | 95 | 105 | −1 |
| Comparative Example 1 | Without Drying Device | 80 | — | — | 32 |
| Comparative Example 2 | FIG. 2 | 80 | 120 | 80 | 28 |
| Comparative Example 3 | FIG. 7 | 80 | 120 | 80 | 22 |
| Comparative Example 4 | FIG. 2 | 80 | 100 | 100 | 16 |

As indicated in Table 1, since no drying device is used in Comparative Example 1, generation of back curl was not restrained effectively. That is, as a result, the back curl with the amount of curl of 32 mm occurred. In addition, using a sheet having a high image area rate (80%) is considered as another reason of generation of the back curl. By contrast, in Comparative Examples 2 and 3, the drying device was used to dry the sheets, and therefore the amount of curl was reduced when compared with Comparative Example 1 that did not use a drying device. Even so, however, the back curl with the amount of 22 mm or more was generated in Comparative Example 1. Since the temperature of the heat roller was set to higher than the temperature of the heat belt in Comparative Examples 2 and 3, the liquid applied face of the sheet was heated at the high temperature. Therefore, it is considered that there was a force that encouraged generation of the back curl acted on the sheet in Comparative Examples 2 and 3, by contract to the effect in the above-described example of the present disclosure. Further, when compared with Comparative Examples 2 and 3, the amount of curl was further reduced in Comparative Example 4. It is considered that, since the heat roller and the heat belt were not set to the same temperature in Comparative Example 4, no heating to encourage generation of the back curl was not performed in Comparative Example 4 as in Comparative Examples 2 and 3. Even so, however, the back curl with the amount of 16 mm was generated in Comparative Example 4.

With respect to the above-described comparative examples, Examples 1 to 8 of the present disclosure reduced the amount of curl from the above-described comparative examples and restrained the amount of curl to 4 mm or smaller. Since the temperature of the heat belt was set to higher than the temperature of the heat roller in each of Examples 1 to 8 of the present disclosure, the opposite face that is opposite the liquid applied face of the sheet was heated at the high temperature. Therefore, it is considered that there was a force exerted in the direction opposite the direction of the force that encouraged generation of the back curl in Examples 1 to 8 of the present disclosure.

Further, in Examples 1 to 8 of the present disclosure, the amount of curl was reduced effectively by adjusting the temperature of the heat belt and the temperature of the heat roller, according to the image area rate. Specifically, Examples 2, 3, 4, 6, 7, and 8 of the present disclosure had the image area rates (60%, 40%, 20%) lower than the image area rates of Examples 1 and 5. In Examples 2, 3, 4, 6, 7, and 8 of the present disclosure, as the image area rate decreased, the temperature of the heat roller was increased and, by contract, the temperature of the heat belt was decreased, so as to adjust the temperature of the heat roller and the temperature of the heat belt to be relatively close to each other. Since the temperature of the heat roller and the temperature of the heat belt were adjusted to be relatively close to each other to reduce the difference between the temperature of the heat roller and the temperature of the heat belt, the force to restrain generation of the back curl due to heating was controlled not to excessively increase. Accordingly, generation of a face curl was restrained.

As described above, it was confirmed, from the test results, that the examples of the present disclosure restrain generation of the back curl effectively when compared with the comparative examples. Further, it was also confirmed that adjustment of the difference between the temperature of the heat roller and the temperature of the heat belt according to the image area rate (liquid application amount to the sheet) restrains generation of back curl and face curl more effectively. Note that, even when either of the configuration of the drying device illustrated in FIG. 2 or the configuration of the drying device illustrated in FIG. 7 is employed, the back curl is restrained effectively. However, the length of the contact area of the heat roller to the heat belt in the configuration of the drying device illustrated in FIG. 7 is longer than the length of the contact area (i.e., the length of the nip region in the sheet conveying direction) of the heat roller to the heat belt in the configuration of the drying device illustrated in FIG. 2. Therefore, the drying device in FIG. 7 has a better ink drying efficiency when compared with the drying device in FIG. 2. By contrast, the configuration of the drying device illustrated in FIG. 7 consumes the larger amount of heat energy when compared with the configuration of the drying device illustrated in FIG. 2. Therefore, the configuration of the drying device illustrated in FIG. 2 is more effective in the energy-saving performance.

Now, descriptions are given of a drying device according to yet another embodiment of the present disclosure.

Figure 8:
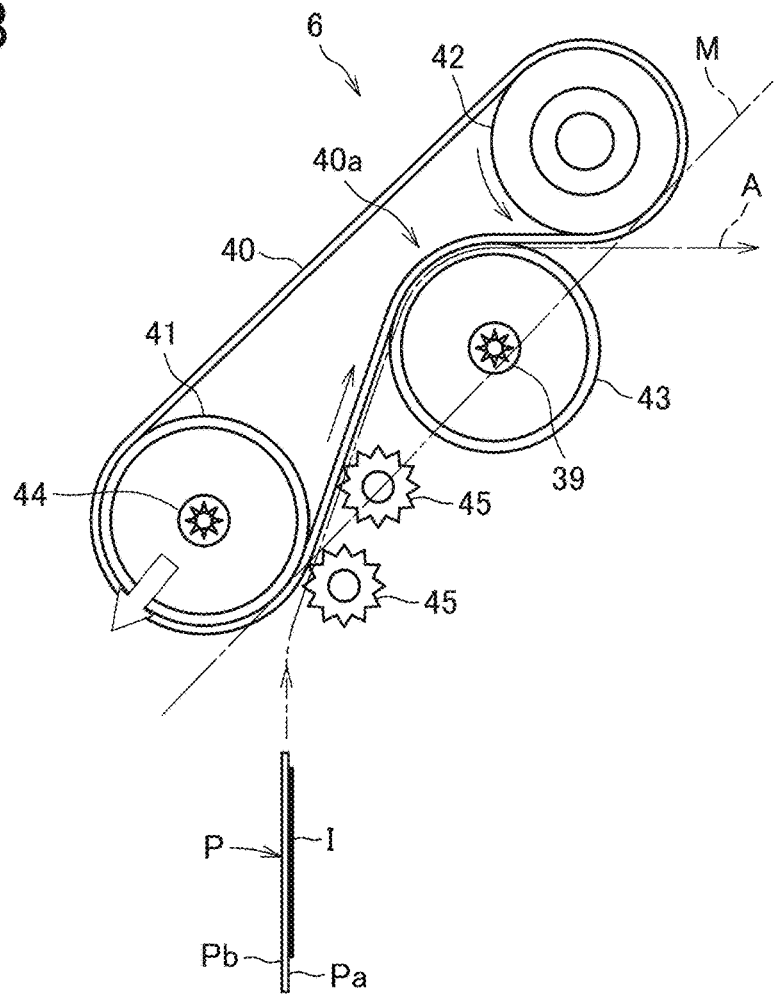
FIG. 8 is a diagram illustrating a configuration of the drying device according to yet another embodiment of the present disclosure.

FIG. 8 is a diagram illustrating a configuration of the drying device according to yet another embodiment of the present disclosure.

Figure 9:
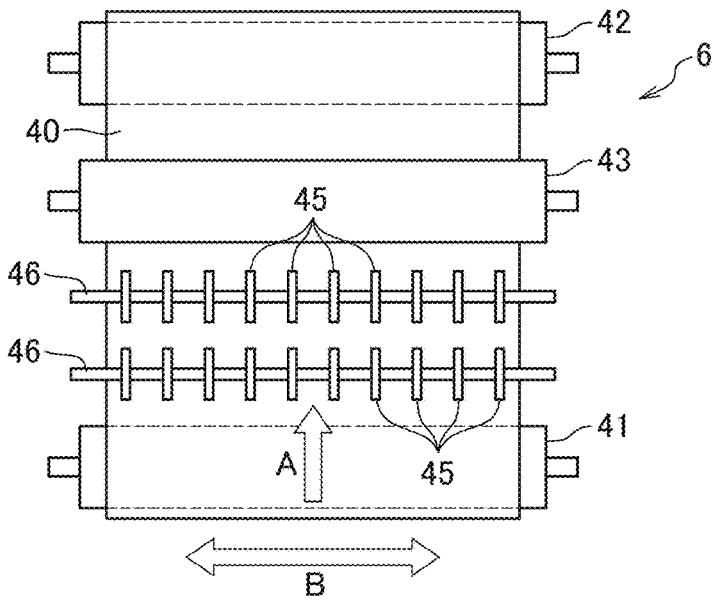
FIG. 9 is a plan view illustrating the drying device indicating the arrangement of spur wheels provided in the drying device of FIG. 2.

FIG. 9 is a plan view illustrating the drying device indicating the arrangement of spur wheels provided in the drying device of FIG. 2.

Figure 10:
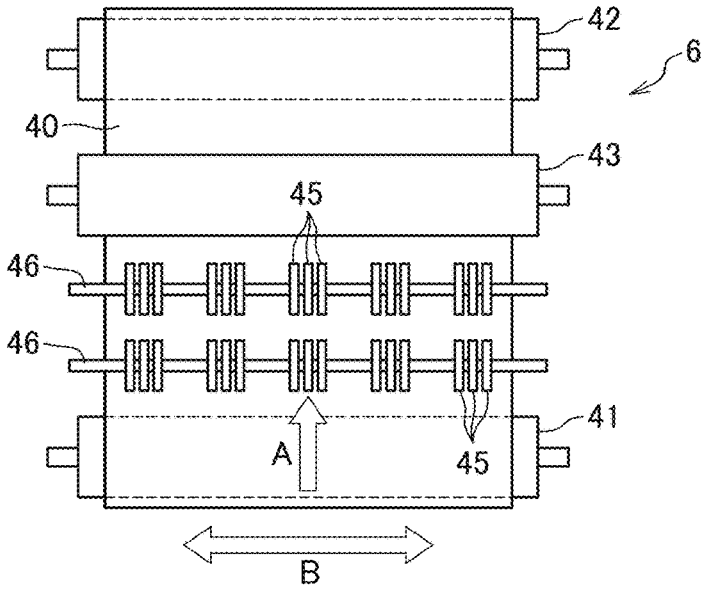
FIG. 10 is a plan view illustrating the drying device indicating another arrangement of the spur wheels.

FIG. 10 is a plan view illustrating the drying device indicating another arrangement of the spur wheels.

In the drying apparatus 6 according to the embodiment illustrated in FIG. 8, the tension roller 41 is disposed further upstream from the heat roller 43 in the sheet conveyance direction A as compared with the configuration of the drying device 6 illustrated in FIG. 7, and a plurality of spur wheels 45 are disposed between the tension roller 41 and the heat roller 43 along the sheet conveyance direction A. The drying device 6 illustrated in FIG. 8 basically has the configuration identical to the configuration of the drying device 6 illustrated in FIG. 7, except that the above-described configuration. Note that, in the present embodiment, as the above-described embodiments, the temperature of the heat belt 40 is controlled to be higher than the temperature of the heat roller 43.

Each spur wheel 45 functions as a projecting rotator having a plurality of projections projecting toward the outer diameter direction. The spur wheels 45 are disposed upstream from the heat roller 43 in a sheet conveyance direction A to contact the outer circumferential surface of the heat belt 40. Further, FIG. 9 is a plan view illustrating the drying device 6 indicating the arrangement of the spur wheels 45 provided in the drying device 6 of FIG. 2. As illustrated in FIG. 3, the spur wheels 45 are mounted on a rotary shaft 46 that extends in a belt width direction indicated by arrow B in FIG. 3 or the sheet width direction. Hereinafter, the direction indicated by arrow B in FIG. 3 is referred to as the belt width direction B. Here, the "belt width direction" or the "sheet width direction" represents a direction intersecting the sheet conveyance direction A along the sheet conveyance passage 22 (see FIG. 1). The plurality of spur wheels 45 may be disposed at equal intervals over the axial direction of the rotary shaft 46 (i.e., the belt width direction or the sheet width direction), as illustrated in FIG. 9 or may be disposed at different intervals. Further, FIG. 10 is a plan view illustrating the drying device 6 indicating another arrangement of the spur wheels 45. As illustrated in FIG. 10, a group of spur wheels, in which the plurality of spur wheels 45 are closely disposed to each other, may be disposed at equal intervals or different intervals over the axial direction of the rotary shaft 46 or may be disposed at different intervals. Further, the spur wheel 45 on the upstream side and the spur wheel 45 on the downstream side in the sheet conveyance direction A may not be at the same position in the sheet conveyance direction A but may be shifted from each other in the axial direction of the rotary shaft 46.

In the drying device 6 according to the present embodiment, the plurality of spur wheels 45 are disposed upstream from the heat roller 43 in the sheet conveyance direction A. Therefore, as the sheet P is conveyed to the drying device 6, the plurality of spur wheels 45 guide the sheet P to contact the heat belt 40 before the sheet P reaches the heat roller 43 (on the upstream side from heat roller 43 in the sheet conveyance direction A). Therefore, the drying device 6 dries the ink on the sheet P while reducing ink smudge (image distortion) on the sheet P. That is, even if the liquid applied face Pa of the sheet P contacts the spur wheel 45 or the plurality of spur wheels 45, since the contact area of the spur wheel 45 or the plurality of spur wheels 45 to the liquid applied face Pa is small, ink smudge on the sheet P caused by the contact of the spur wheel 45 or the plurality of spur wheels 45 to the sheet P is prevented. Further, application of ink to the spur wheel 45 is restrained, so as to reduce smear on the sheet caused by ink being applied from the spur wheel 45 to another sheet.

As described above, the drying device 6 according to the present embodiment causes the plurality of spur wheels 45 to guide the sheet P to contact the heat belt 40 on the upstream side from the heat roller 43 in the sheet conveyance direction A. Therefore, the ink on the sheet P is dried to a certain state (for example, to a state in which ink is not applied to another member) before the sheet P reaches the heat roller 43. Accordingly, as described in the present embodiment, even when the heat roller 43 having the outer circumferential surface of the cylindrical shape is used in order to enhance the closeness of the sheet P to the heat belt 40, application of ink to the heat roller 43 is restrained, thereby reducing deterioration in the image quality due to ink application to the heat roller 43 and smear on the sheet P due to ink application from the heat roller 43 to another sheet.

In addition, in the drying device 6 according to the present embodiment, the heater 44 inside the tension roller 41 is disposed upstream from the heat roller 43 (or the curved portion 40*a* in which the heat roller 43 contacts the heat belt 40) in the sheet conveyance direction A. Therefore, the sheet P is effectively heated on the upstream side from the heat roller 43 in the sheet conveyance direction A. Accordingly, the drying of the ink on the sheet P is accelerated before the sheet P reaches the heat roller 43 and ink application to the heat roller 43 is restrained effectively. In order to further restrain ink application to the heat roller 43, an abrasive roller as the heat roller 43, as illustrated in FIG. 5, or a knurl roller as the heat roller 43, as illustrated in FIG. 6, may be employed.

Further, in the drying device 6 according to the present embodiment, the spur wheel 45 or the plurality of spur wheels 45 conveys the sheet P while contacting the sheet P to the surface of the heat belt 40. Therefore, waving of the sheet P is reduced to cause the sheet P to enter between the heat roller 43 and the heat belt 40. Accordingly, wrinkles that are likely to be generated when the sheet P is gripped and held by the heat roller 43 and the heat belt 40 may be reduced.

Further, as the above-described embodiment illustrated in FIG. 7, in the drying device 6 according to the present embodiment, the sheet P is not strongly pressed on the heat belt 40 by the two rollers, and therefore occurrence of wrinkles of the sheet P is restrained. In addition, since each spur wheel 45 is disposed not to press but to simply contact the heat belt 40, the sheet P is not pressed by the spur wheel 45 or the plurality of spur wheels 45. Further, in the drying device 6 according to the present embodiment, the sheet P is not strongly pressed by the heat roller 43 and the tension roller 41 or by the heat roller 43 and the fixed roller 42. Further, the sheet P is not strongly pressed by the spur wheel 45 or the plurality of spur wheels 45. Therefore, the sheet P is conveyed by the plurality of spur wheels 45 while being held in a flat shape on the heat belt 40, and enters in a flat shape on the heat belt 40 between the heat roller 43 and the heat belt 40, thereby restraining occurrence of wrinkles on the sheet P. Further, as the above-described embodiment illustrated in FIG. 7, the load and rotational resistance to be applied to the heat belt 40 when the heat roller 43 presses the heat belt 40 is also reduced.

Note that the plurality of spur wheels 45 may not contact the outer circumferential surface of the heat belt 40. As long as the sheet P is conveyed while being held in a flat shape without waving on the heat belt 40, the spur wheel 45 or the plurality of spur wheels 45 may be disposed close to the outer circumferential surface of the heat belt 40 (indirectly contacting the outer circumferential surface of the heat belt 40 via a gap). In other words, as long as a good conveyability of sheets is obtained, the spur wheel 45 or the plurality of spur wheels 45 may be in contact with the heat belt 40 or without contacting the heat belt 40 and may be at least disposed facing the outer circumferential surface of the heat belt 40.

Figure 11:
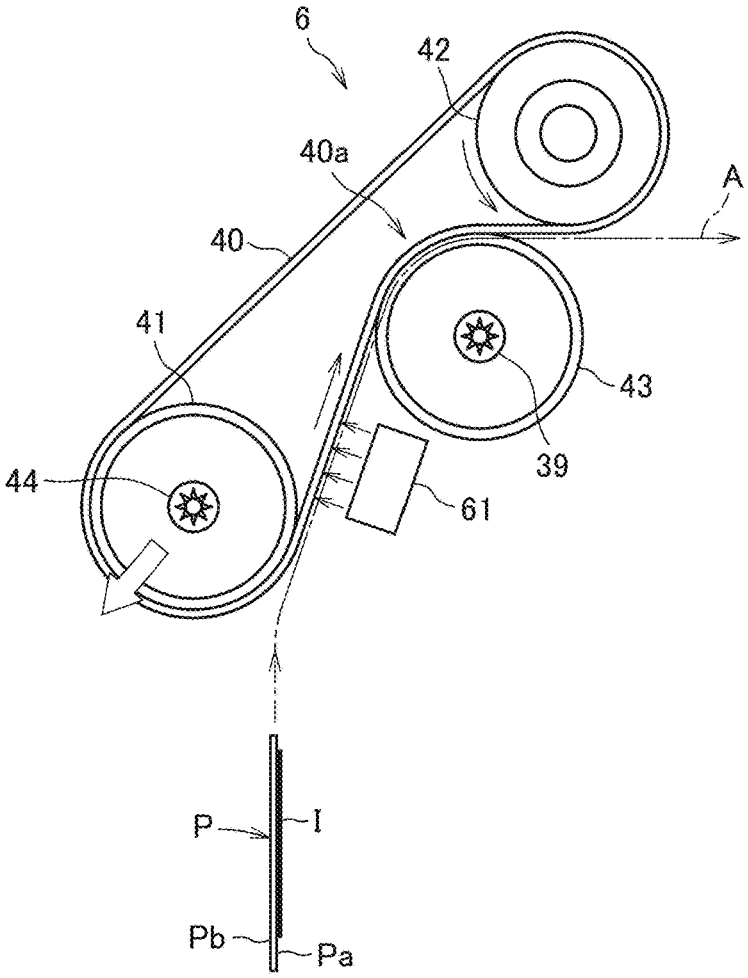
FIG. 11 is a diagram illustrating an example of an air blowing fan instead of the spur wheels.

FIG. 11 is a diagram illustrating an example of an air blowing fan instead of the spur wheels 45.

That is, as illustrated in FIG. 11, instead of the spur wheel 45, an air blowing fan 61 that functions as an air blower may be employed. In this case, the air blowing fan 61 blows air to cause the sheet P to contact the heat belt 40. By so doing, the sheet P is conveyed while being held in a flat shape without being pressed strongly. Further, the air blowing fan 61 may be a warm air blowing fan that blows warm air to restrain the heat belt 40 from being cooled.

Further, instead of the spur wheel 45, the heat belt 40 may be charged, so that the sheet P is electrostatically attracted to the heat belt 40.

Figure 12:
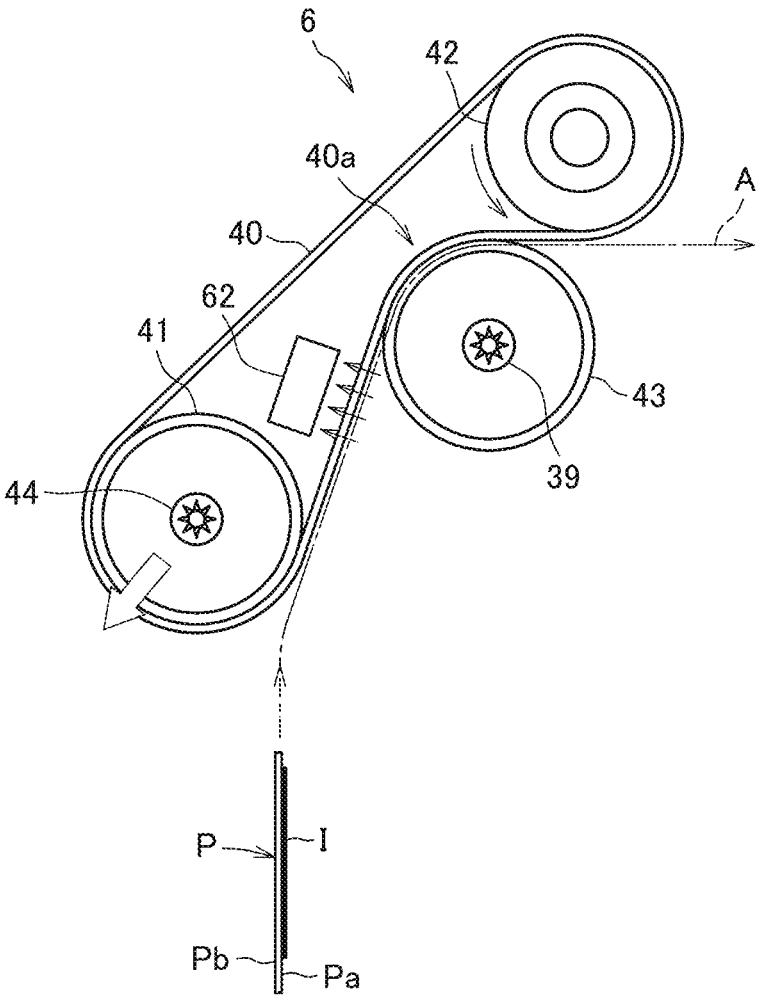
FIG. 12 is a diagram illustrating an example of an air suction fan instead of the spur wheels.

Further, FIG. 12 is a diagram illustrating an example of an air suction fan instead of the spur wheels.

To be more specific, as yet another example, as illustrated in FIG. 12, an air suction fan 62 may be disposed inside the loop of the heat belt 40. In this case, the heat belt 40 has a plurality of air holes and the air suction fan 62 sucks air from the plurality of air holes of the heat belt 40. By so doing, the sheet P is attracted to the heat belt 40. In this case, the air suction fan 62 sucks air to convey the sheet P while being held in a flat shape without being pressed strongly.

Figure 13:
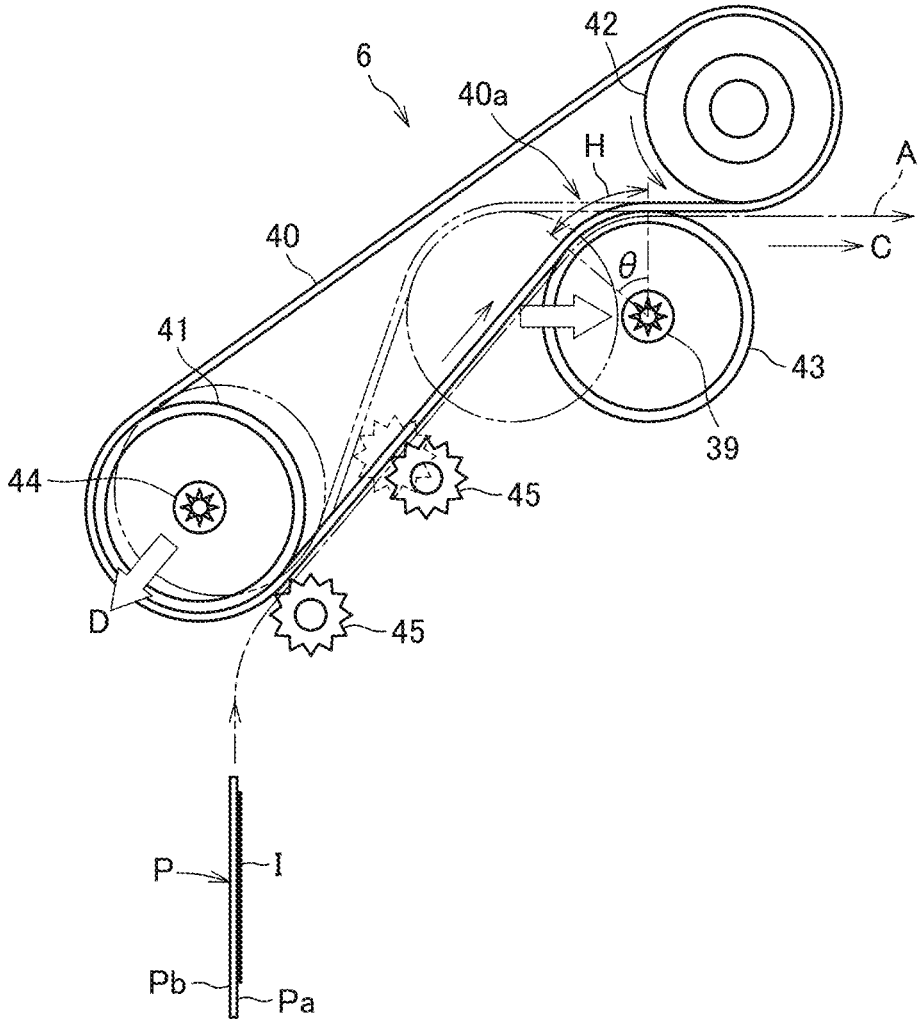
FIG. 13 is a diagram illustrating an example that the winding angle of the heat belt around the heat roller is changeable.

FIG. 13 is a diagram illustrating an example that the winding angle of the heat belt around the heat roller is changeable.

As illustrated in FIG. 13, the heat roller 43 may be moved to change the winding angle θ of the heat belt 40 to the heat roller 43. Accordingly, the length H of the contact area (curved portion 40*a*) in the sheet conveyance direction A in which the heat roller 43 and the heat belt 40 contact is changeable.

To be more specific, when an image having a low coverage rate with texts, for example, the amount of ink application to the sheet P is relatively small, and therefore it is not likely to generate back curl easily. Therefore, when an image having a low coverage rate is formed on the sheet P, as illustrated in FIG. 13, the heat roller 43 is moved to the right side in FIG. 13 to reduce the winding angle θ of the heat belt 40 to the heat roller 43, so as to reduce the length H of the contact area in the sheet conveyance direction A. In this case, a decurling action when the sheet P passes the curved portion 40*a* of the heat belt 40 is decreased to apply a decurling force corresponding to the amount of curl of a possible back curl. Further, in this case, a reduction in the winding angle θ decreases the time to heat the sheet P while the sheet P is pressed against the heat belt 40 by the heat roller 43. However, the sheet P having the low coverage rate and the low amount of ink application takes a shorter time to heat the sheet P for drying, and therefore the winding angle θ of the heat belt may be small. Further, in this case, the amount of heat to be applied to the sheet P from the heat belt 40 decreases, the energy-saving performance is enhanced.

By contrast, when an image having a high coverage rate and the high amount of ink application is formed, the heat roller 43 is moved to the left side in FIG. 13 to increase the winding angle θ of the heat belt 40 to the heat roller 43, so as to increase the length H of the contact area in the sheet conveyance direction A. Accordingly, the decurling action when the sheet P passes the curved portion 40*a* of the heat belt 40 is increased to effectively restrain deformation of the sheet such as back curl.

Further, when a relatively thick sheet P such as a thick paper is conveyed, if the winding angle θ is large, it is difficult to warp and convey the sheet P. Therefore, it is preferable to make the winding angle θ relatively small. By making the winding angle θ relatively small, even when the thick sheet P is conveyed, the sheet P is smoothly conveyed, and therefore occurrence of a conveyance failure may be prevented. As described above, by accordingly changing the winding angle θ depending on the thickness of the sheet and the amount of ink application to the above-described sheet, deformation of the sheet is effectively restrained, and the conveyance performance and the energy-saving performance are enhanced.

Further, in order to enhance the energy-saving performance, as the above-described embodiment, at least one of the temperature of the heat roller 43 and the temperature of the heat belt 40 may be controlled (adjustable) according to the amount of ink application to the sheet P. Further, when the amount of liquid application to the sheet P is relatively small, the back curl hardly occurs, when compared with a case in which the amount of liquid application to the sheet P is relatively large. Therefore, the temperature of the heat roller 43 and the temperature of the heat belt 40 may be relatively close to each other to reduce the difference between the temperature of the heat roller 43 and the temperature of the heat belt 40. In other words, the difference between the temperature of the heat roller 43 and the temperature of the heat belt 40 is smaller with a smaller amount of ink application to the sheet P than with a larger amount of ink application to the sheet P. Alternatively, when the amount of liquid application is equal to or smaller than the predetermined amount of liquid application, the difference between the temperature of the heat roller 43 and the temperature of the heat belt 40 may be controlled to be equal to or smaller than the predetermined temperature.

Further, as illustrated in FIG. 13, it is preferable that the direction of movement of the heat roller 43 is parallel to the direction of the heat belt 40 extending toward downstream from the heat roller 43 in the sheet conveyance direction A (i.e., the direction indicated by arrow C in FIG. 13). By so doing, even when the heat roller 43 is moved, the sheet ejection direction of the sheet P from the drying device 6 may not be changed, thereby ejecting the sheet P reliably.

Further, as illustrated in FIG. 13, as the heat roller 43 moves, the tension roller 41 moves together with the heat roller 43 at the same time, so that the tension applied to the heat belt 40 is adjusted to the predetermined value. At this time, by setting the direction of movement of the tension roller 41 to the direction obliquely downward to the left (direction indicated by arrow D in FIG. 13) and the direction opposite the direction obliquely downward to the left, the spur wheel 45 at the extreme upstream position in the sheet conveyance direction A and the heat belt 40 are continuously in contact with each other and maintain the contact state without moving the spur wheel 45 at the extreme upstream position. Accordingly, the entrance position and entrance angle at which the sheet P enters between the extreme upstream spur wheel 45 and the heat belt 40 in the sheet conveyance direction A do not change, and the entrance of the sheet P may be made reliably.

Figure 14:
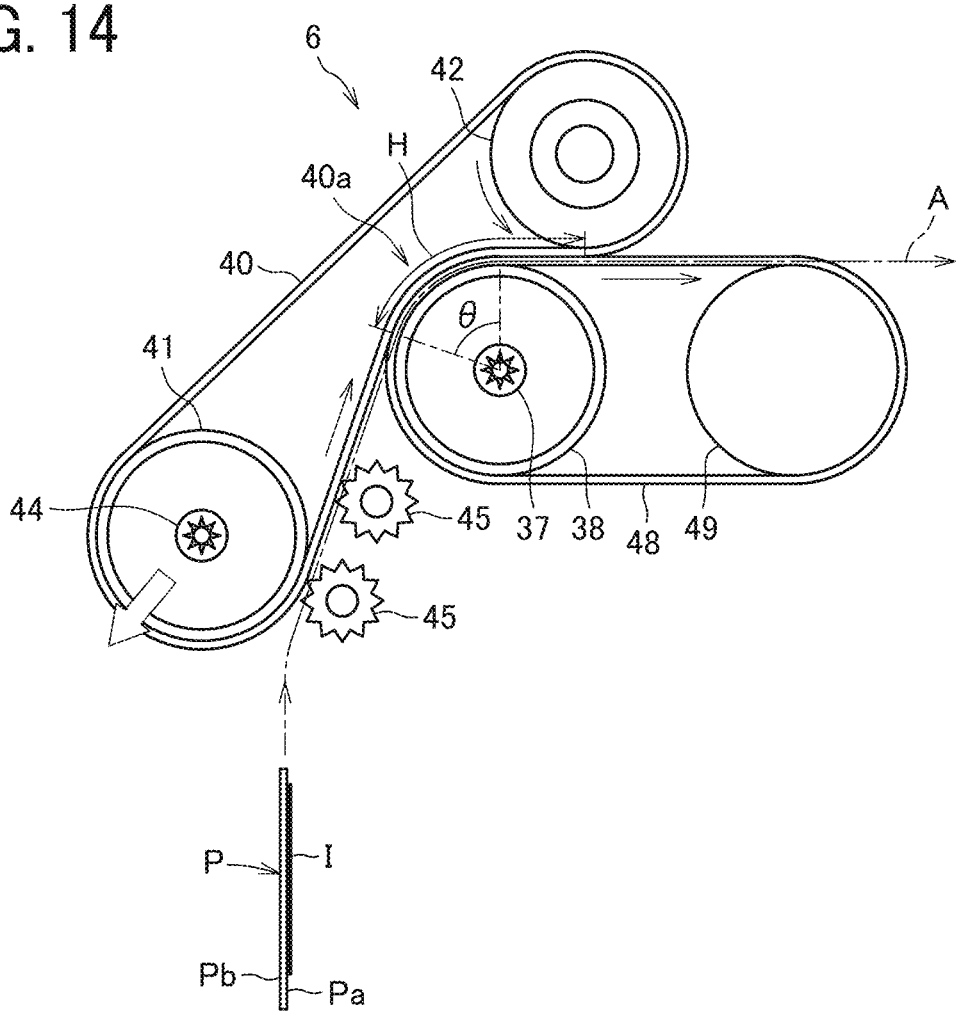
FIG. 14 is a diagram illustrating a configuration of the drying device according to yet another embodiment of the present disclosure.

FIG. 14 is a diagram illustrating a configuration of the drying device 6 according to yet another embodiment of the present disclosure.

The drying device 6 illustrated in FIG. 14 includes a heat belt 48 stretched by two support rollers 38 and 49, in addition to the heat belt 40 described above. Hereinafter, the heat belt 48 is also referred to as a first heat belt 48 and the heat belt 40 is also referred to as a second heat belt 40. That is, the drying device 6 according to the present embodiment includes the first heat belt 48 and the second heat belt 40. The first heat belt 48 functions as a first heating member that contacts the liquid applied face Pa of the sheet P to heat the sheet P. The second heat belt 40 functions as a second heating member that contacts the opposite face Pb that is opposite the liquid applied face Pa of the sheet P to heat the sheet P The drying device 6 illustrated in FIG. 14 basically has the configuration identical to the configuration of the drying device 6 illustrated in FIG. 8, except the drying device 6 illustrated in FIG. 14 has another heat belt, that is, the second heat belt 40.

In the present embodiment, of the support rollers 38 and 49 stretching the first heat belt 48, the support roller 38 on the left side of FIG. 14 is biased toward the second heat belt 40, so that the curved portion 40*a* of the second heat belt 40 is formed between the tension roller 41 and the fixed roller 42. That is, in the present embodiment, the support roller 38 on the left side of FIG. 14 and the first heat belt 48 each functions as a pressing member that presses the second heat belt 40 and forms the curved portion 40*a*. As the fixed roller 42 around which the second heat belt 40 is wound is driven and rotated, the second heat belt 40, the tension roller 41, the first heat belt 48, the support roller 38, and the support roller 49 are rotated along with rotation of the fixed roller 42. Further, either one of the support rollers 38 and 49 may function as a drive roller.

In the drying device 6 according to the present embodiment, when the sheet P is conveyed, the sheet P is guided by the spur wheel 45 to contact the second heat belt 40, so that the opposite face Pb of the sheet P that is opposite the liquid applied face Pa of the sheet P contacts the second heat belt 40 to heat the sheet P. Then, as the sheet P enters between the first heat belt 48 and the second heat belt 40, the liquid applied face Pa of the sheet P contacts the first heat belt 48 to heat the sheet P. At this time, the sheet P is heated from both the front and back sides of the sheet P by the first heat belt 48 and the second heat belt 40. However, the temperature of the second heat belt 40 is controlled to be higher than the temperature of the first heat belt 48, and the opposite face Pb that is opposite the liquid applied face Pa is heated at a temperature higher than the temperature of the liquid applied face Pa of the sheet P. For this reason, as the above-described embodiments, in the present embodiment, the force is exerted in the opposite direction opposite the force to generate a back curl on the sheet P. Further, when the sheet P enters between the first heat belt 48 and the second heat belt 40, the sheet P is warped in the direction opposite the curve direction of the back curl along the curved portion 40*a* of the second heat belt 40. Therefore, as the above-described embodiments, in the present embodiment, occurrence of back curl is restrained effectively.

Further, the drying device 6 according to the present embodiment employs two belts (e.g., the first heat belt 48 and the second heat belt 40) which are in contact with each other to convey the sheet P while gripping (holding) the sheet P. Therefore, the area in which the two belts convey the sheet P while gripping (holding) the sheet P (i.e., the area indicated by H in FIG. 14) extends largely in the sheet conveyance direction A. Consequently, the sheet P is heated effectively. Accordingly, the drying device 6 according to the present embodiment further accelerates the drying of ink on the sheet P, and therefore effectively restrains, and prevents if possible, deformation of a sheet such as back curl.

In addition, in the drying device 6 according to the present embodiment, the first heat belt 48 is stretched around by the support rollers 38 and 49 and the support roller 38 is disposed upstream from the support roller 49 in the sheet conveyance direction A. Since the support roller 38 has a heater 37 inside, the sheet P is effectively heated on the first heat belt 48 on the upstream side in the sheet conveyance direction A. This heating of the sheet P accelerates drying of the ink at an earlier stage.

In addition, in the drying device 6 according to the present embodiment, the first heat belt 48 is disposed to extend not to the upstream side but to the downstream side from the curved portion 40*a* in the sheet conveyance direction A, thereby restraining the ink application to the first heat belt 48. That is, the ink on the sheet P is dried while being guided by the spur wheel 45 or the plurality of spur wheels 45 on the upstream side from the curved portion 40*a* in the sheet conveyance direction A. Therefore, even if the sheet P contacts the first heat belt 48 after the sheet P is dried on the upstream side, the ink application to the first heat belt 48 is restrained.

Figure 15:
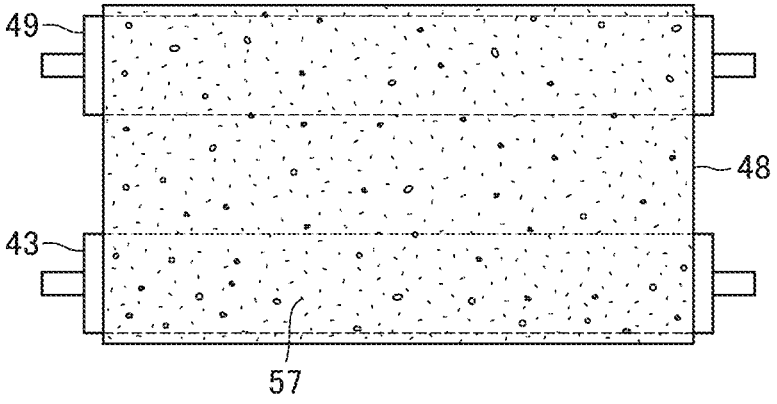
FIG. 15 is a diagram illustrating an example that the outer circumferential surface of a first heat belt has fine surface asperities.

FIG. 15 is a diagram illustrating an example that the outer circumferential surface of a first heat belt has fine surface asperities.

Figure 16:
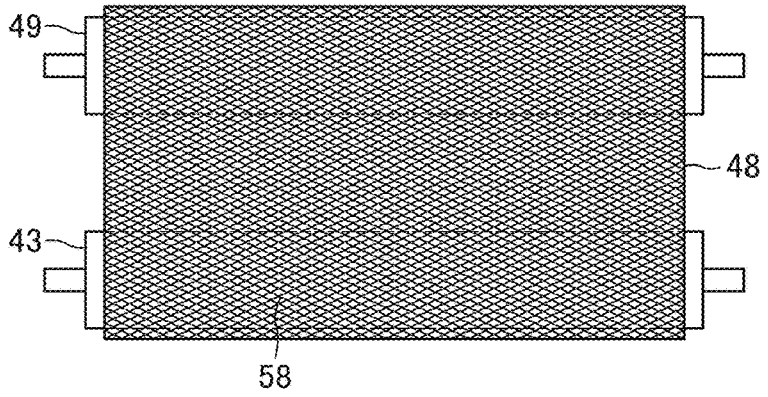
FIG. 16 is a diagram illustrating an example that the first heat belt has a mesh pattern.

FIG. 16 is a diagram illustrating an example that the first heat belt has a mesh pattern.

The first heat belt 48 may include a belt 57 having the uneven outer circumferential surface, in other words, having fine asperities on the outer circumferential surface, as illustrated in FIG. 15, or a belt 58 having a mesh pattern, as illustrated in FIG. 16, may be employed in order to restrain ink application to the first heat belt 48 more effectively.

Further, as in the example illustrated in FIG. 13, in the drying device 6 illustrated in FIG. 14 may allow the heat roller 43 to move according to the amount of ink application to the sheet P. According to this configuration, the winding angle θ of the second heat belt 40 to the first heat belt 48 is changed to change the length H of the contact area (curved portion 40*a*) in the sheet conveyance direction A in which the first heat belt 48 and the second heat belt 40 contact with each other. Further, the amount of heat generation of the heater 47 may be controlled according to the amount of ink application to the sheet P.

Further, the drying device (heating device) according to the present disclosure is not limited to each of the above-described embodiments and variation.

Figure 17:
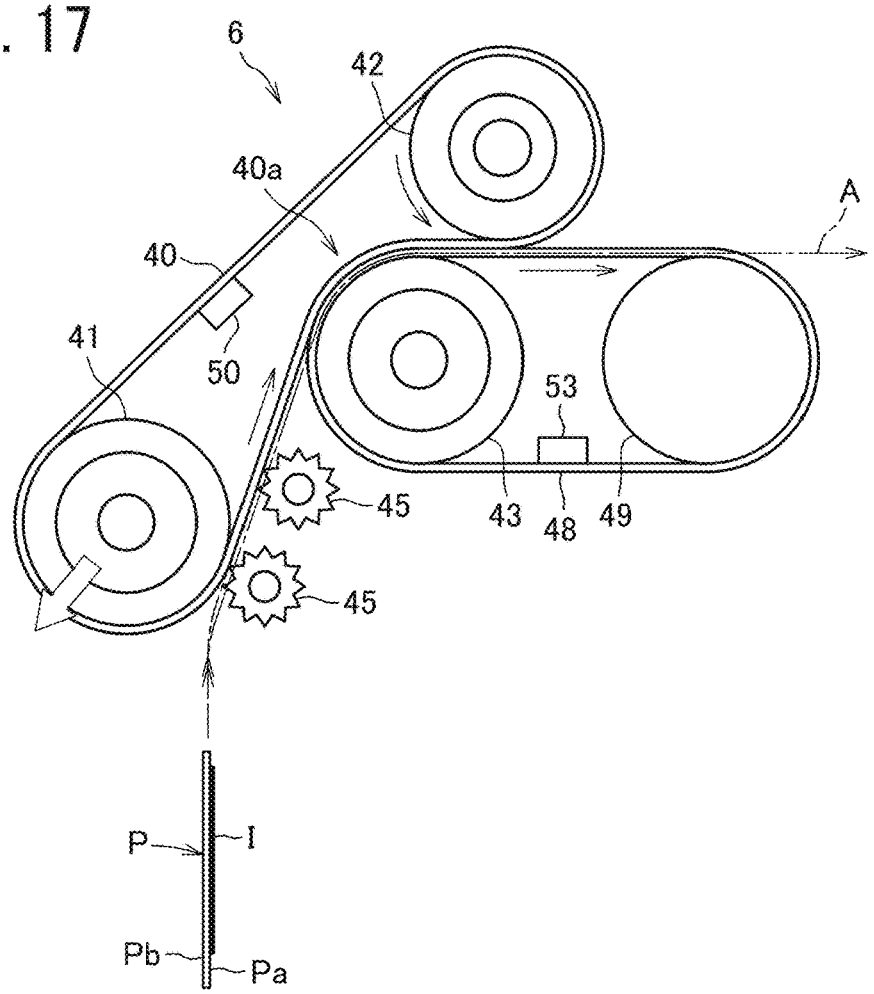
FIG. 17 is a diagram illustrating an example that a ceramic heater functioning as a heat source is employed to contact the heat belt.

FIG. 17 is a diagram illustrating an example that a ceramic heater functioning as a heat source is employed to contact the heat belt.

For example, in the drying device (heating device) according to the present disclosure, the heat source to heat the heating member such as the heat roller and the heat belt is not limited to a member (e.g., a halogen heater) disposed not to contact the heating member. That is, as ceramic heaters 50 and 53, a contact-type heat source that contacts the first heat belt 48 and the second heat belt 40 may be employed. Further, such a contact-type heat source may come into contact with the inner circumferential surface of the first heat belt 48 or the second heat belt 40, or may come into contact with the outer circumferential surface of the first heat belt 48 or the second heat belt 40. In this case, however, since the contact-type heat source relatively slides on the heating member while the heating member is rotating, in order to reduce the sliding resistance at this time, it is preferable that a slide sheet including a low friction material may be inserted between the heat source and the heating member or a sheet metal such as aluminum having a slide coating to enhance the thermal conductivity efficiency.

Figure 18:
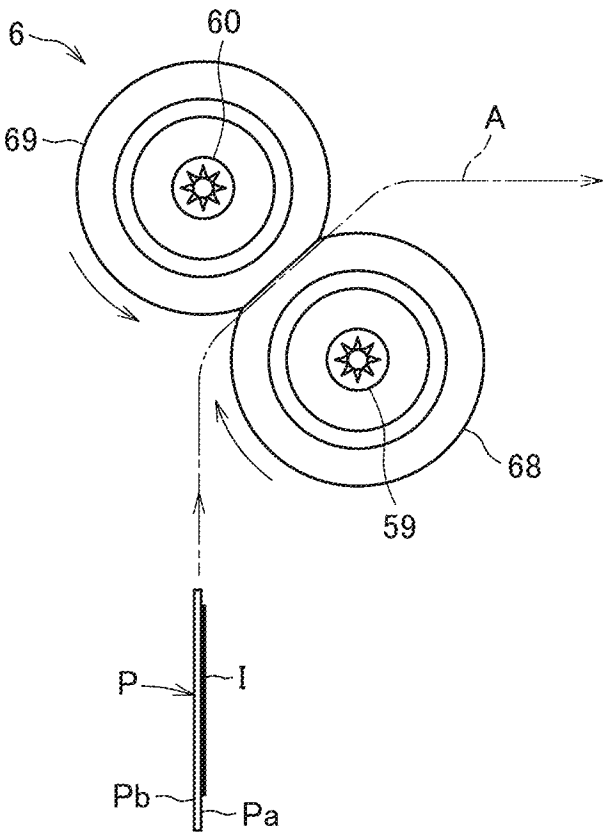
FIG. 18 is a diagram illustrating an example in which a pair of heat rollers function as a first heating member and a second heating member.

FIG. 18 is a diagram illustrating an example in which a pair of heat rollers function as a first heating member and a second heating member.

As illustrated in FIG. 18, the first heating member and the second heating member each heating the sheet P may be heat rollers 68 and 69. The heat rollers 68 and 69 contact (press) each other as a pair of heat rollers and have heaters 59 and 60 inside, respectively. Even in the drying device (heating device) provided with such a first heat roller 68 and a second heat roller 69 forming a pair of heat rollers, the temperature of the second heat roller 69 that heats the opposite face Pb that is opposite the liquid applied face Pa of the sheet P is set to be higher than the temperature of the first heat roller 68 that heats the liquid applied face Pa of the sheet P. By so doing, as the above-described embodiments, the opposite face Pb opposite the liquid applied face Pa of the sheet P is heated at the higher temperature than the liquid applied face Pa, thereby restraining generation of back curl effectively. However, from the viewpoint of energy saving, the second heating member that temperature of which is set to be higher than the temperature of the first heating member such as the belt is preferably made of a member radially thinner than the first heating member and has a heat capacity smaller than the first heating member.

Figure 19:
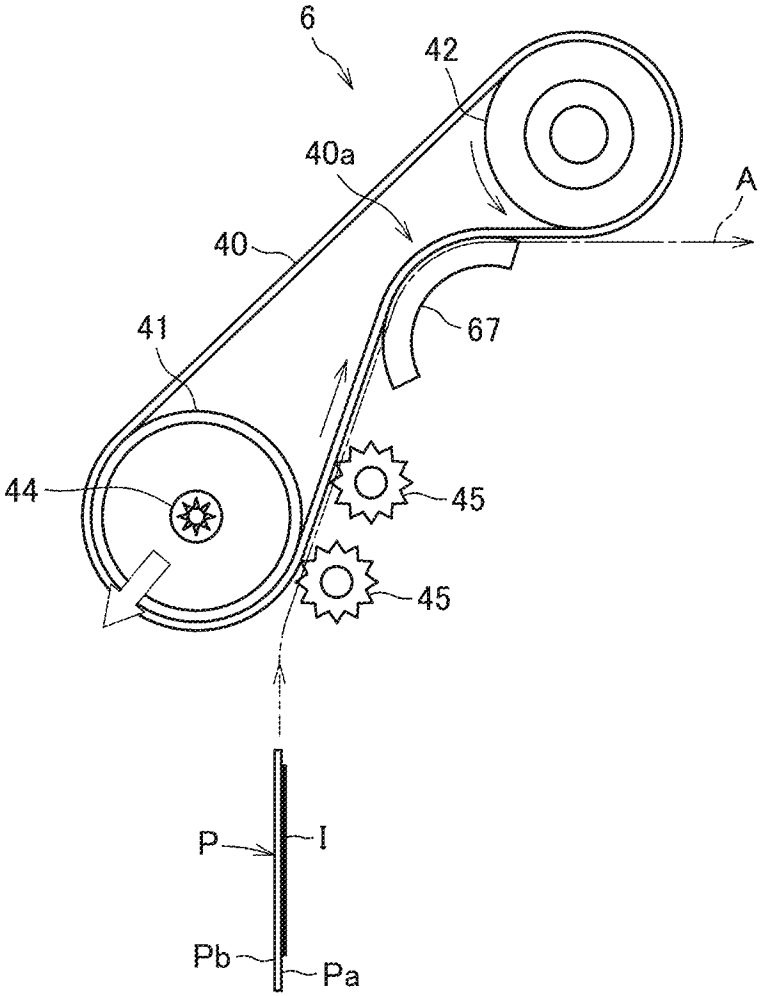
FIG. 19 is a diagram illustrating an example that a heating guide that does not rotate is employed as a first heating member.

Further, FIG. 19 is a diagram illustrating an example that a heating guide that does not rotate is employed as a first heating member.

In the drying device (heating device) according to the present disclosure, the heating member to heat the sheet P is not limited to a rotary body such as a roller and a belt. For example, in a case in which the liquid to be applied to the sheet is a processing liquid that does not form an image, even if the heating member does not rotate along with the sheet, no problem of smear of the image does not occur. FIG. 19 is a diagram illustrating an example that a heat guide that does not rotate is employed as a heating member. In the above-described case using a processing liquid, as illustrated in FIG. 19, the first heating member that contact the liquid applied face Pa of the sheet P may be a heat guide 67 that does not rotate. In this case, the temperature of the heat belt 40 that functions as a second heating member is set to be higher than the temperature of the heat guide 67, thereby restraining generation of back curl effectively. Further, in this case, it is preferable to insert a slide sheet that includes a low friction material, between the heat belt 40 and the heat guide 67 that does not rotate, in order to reduce the sliding resistance that is generated between the heat belt 40 and the heat guide 67.

Figure 20:
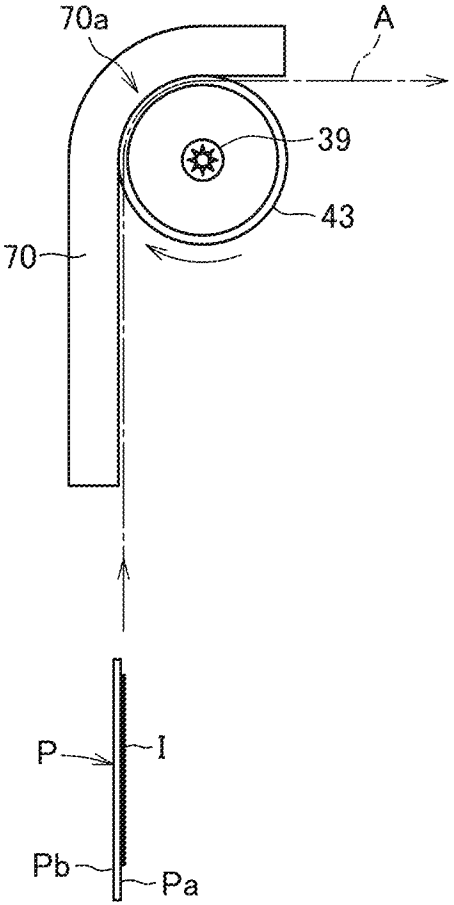
FIG. 20 is a diagram illustrating an example that a heating guide that does not rotate is employed as a second heating member.

FIG. 20 is a diagram illustrating an example that a heat guide that does not rotate is employed as a second heating member.

As illustrated in FIG. 20, for example, the second heating member that contacts the opposite face Pb opposite the liquid applied face Pa of the sheet P may be a heat guide 70 that does not rotate. The heat guide 70 includes a curved portion 70*a* along which the sheet P is warped so that the liquid applied face Pa of the sheet P has a recessed (concave) shape. By setting the temperature of the heat guide 70 higher than the temperature of the heat roller 43 as a first heating member, generation of back curl is restrained effectively. Further, in this case, a slide sheet that includes a low friction material may be inserted between the heat roller 43 and the heat guide 70 that does not rotate, in order to reduce the sliding resistance that is generated between the heat roller 43 and the heat guide 67.

Further, the first heating member and the second heating member that heat the sheet P may not be disposed to contact with each other.

Figure 21:
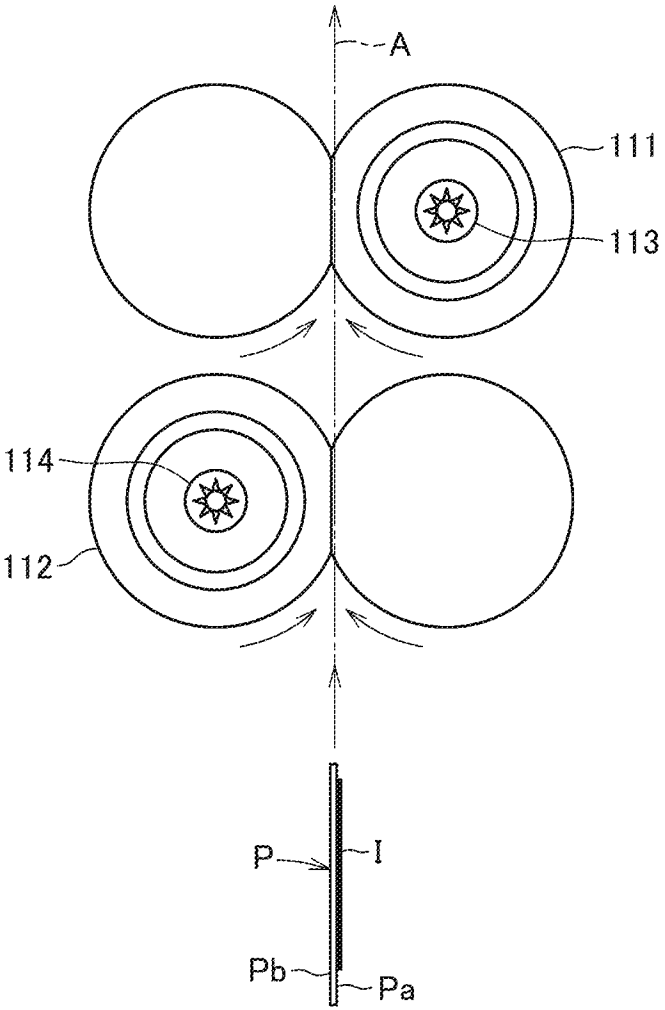
FIG. 21 is a diagram illustrating an example in which the first heating member and the second heating member do not contact with each other.

For example, FIG. 21 is a diagram illustrating an example in which the first heating member and the second heating member do not contact with each other.

As illustrated in FIG. 21, the first heat roller 111 that functions as a first heating member having a heater 113 inside and the second heat roller 112 that functions as a second heating member having a heater 114 inside may be disposed apart from each other in the sheet conveyance direction A so as not to contact with each other. In this case, in controlling the temperature of the second heat roller 112 to be higher than the temperature of the first heat roller 111, it is preferable to control the temperature in consideration of the following circumstances. That is, in the example illustrated in FIG. 21, after the sheet P has passed through the nip region of the second heat roller 112, the temperature of the surface of the sheet P decreases before the sheet P enters the nip region of the first heat roller 111. Therefore, the first heat roller 111 may need to heat the sheet P so that the temperature of the liquid applied face Pa of the sheet P does not become higher than the temperature of the opposite face Pb that is opposite the liquid applied face Pa of the sheet P. Therefore, it is preferable to control the temperature of the first heat roller 111 to be lower than the temperature of the opposite face Pb that is opposite the liquid applied face Pa of the sheet P when the sheet P enters the nip region of the first heat roller 111. By controlling the temperature of the first heat roller 111 as described above, the opposite face Pb of the sheet P that is opposite the liquid applied face Pa of the sheet P is maintained to be higher than the temperature of the liquid applied face Pa of the sheet P, so that back curl is restrained effectively.

Figure 22:
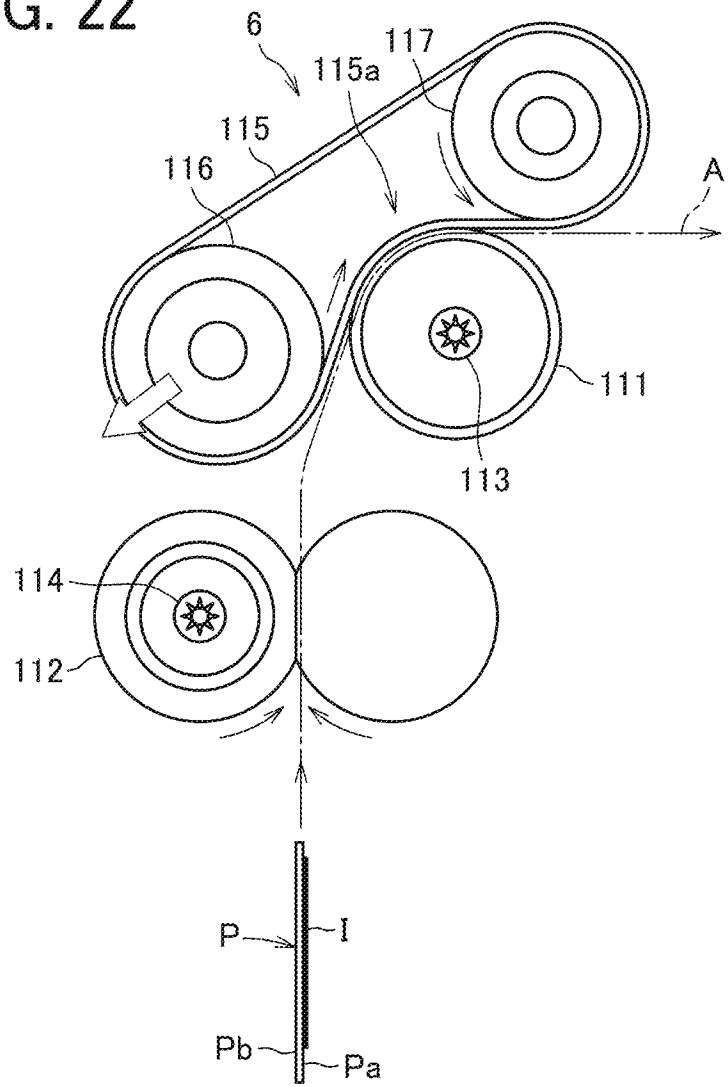
FIG. 22 is a diagram illustrating an example that the first heat roller contacts a belt.

FIG. 22 is a diagram illustrating an example that the first heat roller contacts a belt.

As illustrated in FIG. 22, a belt 115 may contact the first heat roller 111. The belt 115 is an endless belt stretched between two support rollers, which are a support roller 116 and a support roller 117. Further, since the first heat roller 111 is pressed against the belt 115, the belt 115 has a curved portion 115*a* that curves along the outer circumferential surface of the first heat roller 111.

In this example, the second heat roller 112 heats the opposite face Pb that is opposite the liquid applied face Pa of the sheet P. By so doing, the opposite face Pb of the sheet P is heated at the temperature higher than the temperature of the liquid applied face Pa of the sheet P. Therefore, generation of back curl to the sheet P is restrained. Thereafter, the sheet P enters a nip region formed between the first heat roller 111 and the belt 115. At this time, even if the temperature of the first heat roller 111 is controlled to be lower than the temperature of the second heat roller 112, when the temperature of the opposite face Pb is lower than the temperature of the first heat roller 111 as the sheet P enters the nip region of the first heat roller 111, it is likely that the force that generates the back curl illustrated in FIG. 4 may act on the sheet P. However, even in such a case, the sheet P is warped in the opposite direction that is opposite the curve direction of the back curl as the sheet P passes along the curved portion 115*a* of the belt 115. Therefore, occurrence of back curl by heating the sheet P by the first heat roller 111 is restrained.

Figure 23:
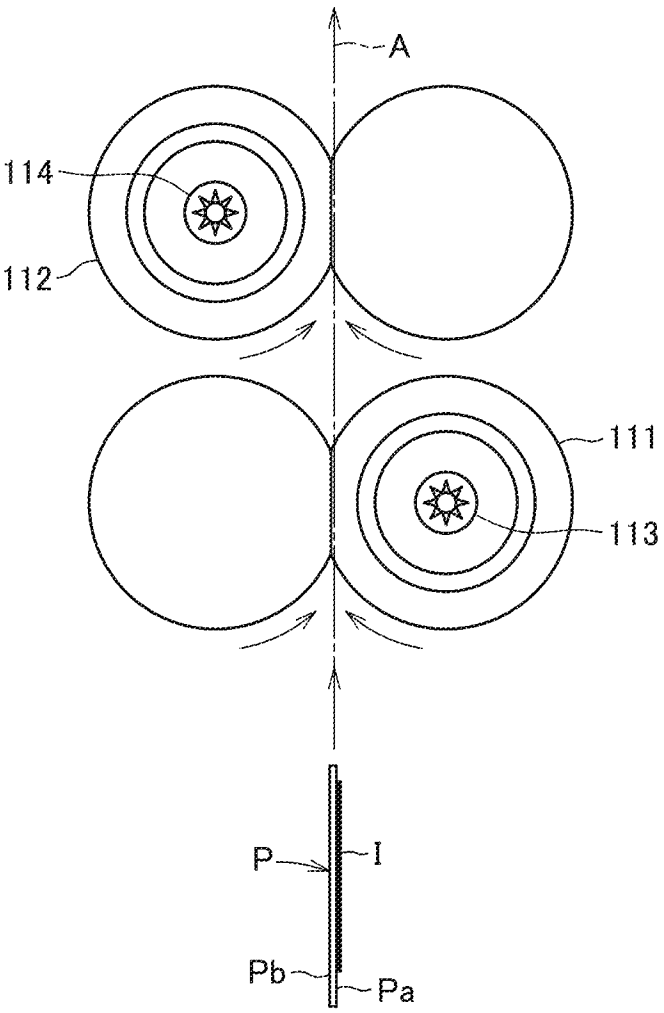
FIG. 23 is a diagram illustrating an example in which the position of the first heat roller and the position of a second heat roller in a sheet conveyance direction are reversed from the positions illustrated in FIG. 21.

FIG. 23 is a diagram illustrating an example in which the position of the first heat roller and the position of a second heat roller in a sheet conveyance direction are reversed from the positions illustrated in FIG. 21.

As illustrated in FIG. 23, the positions of the first heat roller 111 and the second heat roller 112 may be switched from FIG. 21. That is, the first heat roller 111 may be disposed upstream from the second heat roller 112 in the sheet conveyance direction A. In this case, as the liquid applied face Pa of the sheet P contacts the first heat roller 111, the liquid applied face Pa of the sheet P is heated at a relatively high temperature. Therefore, a force that generates back curl to the sheet P, as illustrated in FIG. 4. However, since the temperature of the second heat roller 112 is set to be higher than the temperature of the first heat roller 111, after the liquid applied face Pa of the sheet P is heated by the first heat roller 111, the opposite face Pb of the sheet P is heated by the second heat roller 112 at the higher temperature. Accordingly, the force is exerted in the opposite direction opposite the force to generate a back curl on the sheet P, thereby restraining generation of the back curl.

Figure 24:
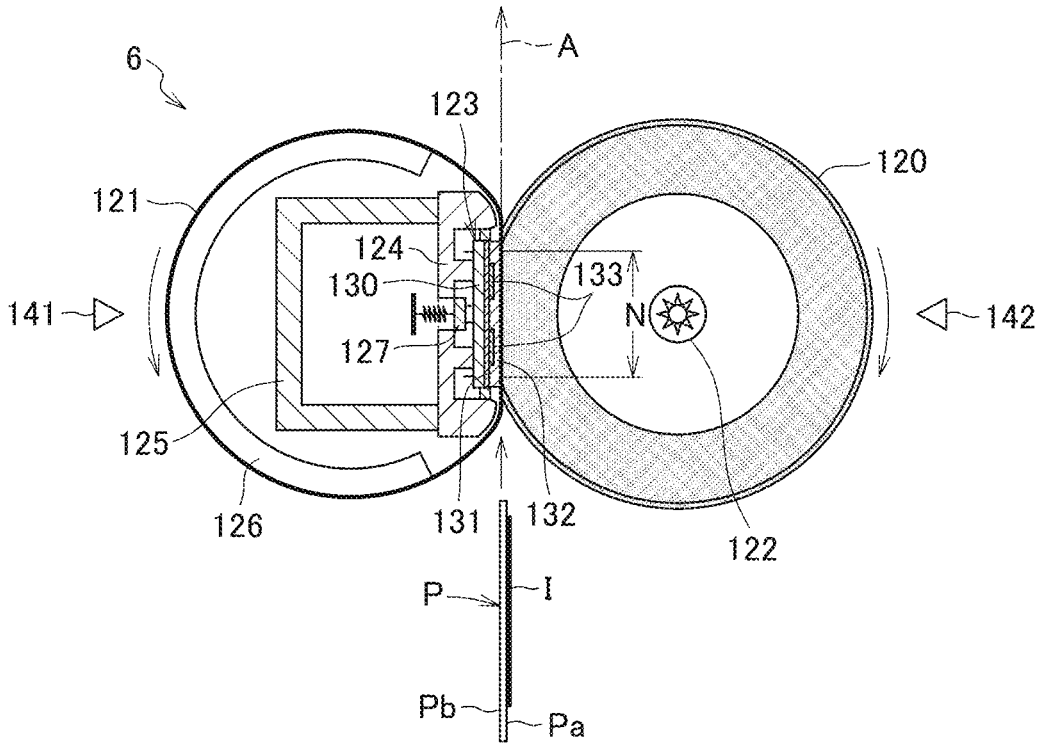
FIG. 24 is a diagram illustrating an example that a flat or planar heater is employed as a heat source.

FIG. 24 is a diagram illustrating an example that a flat or planar heater is employed as a heat source.

As illustrated in FIG. 24, the present disclosure is also applicable to a heater 123 having a flat shape or a planar shape. The drying device 6 illustrated in FIG. 24 includes a heat roller 120, a heat belt 121, two heaters 122 and 123, a heater holder 124, a stay 125, a belt support 126, and a thermistor 127.

The heat roller 120 functions as a first heating member that heats the liquid applied face Pa of the sheet P. The heat belt 121 is a second heating member that heats the opposite face Pb opposite the liquid applied face Pa of the sheet P. The heat roller 120, the heat belt 121, and the belt support 126 basically have the structures identical to the heat roller 90, the heat belt 91, and the belt support 97 illustrated in FIG. 2.

The heater 122 disposed in the heat roller 120 is a halogen heater, for example. The heater 123 disposed in the heat belt 121 is a halogen heater having a flat shape or a planar shape.

The heater 123 disposed in the heat belt 121 includes a base material 130, a first insulation layer 131, a second insulation layer 132, and a resistance heating element 133. The base material 130 is a planar member made of a metal material such as aluminum or stainless steel, ceramics, or glass. The first insulation layer 131 is mounted on the base material 130 and the resistance heating element 133 is mounted on the first insulation layer 131. Further, the resistance heating element 133 is covered with the second insulation layer 132.

The heater 123 is disposed to contact the inner circumferential surface of the heat belt 121. Further, the heater 123 is held by a heater holder 124 that functions as a holding member. Further, the heater 123 is supported by a stay 125 that functions as a support, via the heater holder 124. When the heat roller 120 is pressed against the heater 123 via the heat belt 121, a nip region N is formed between the heat belt 121 and the heat roller 120.

Similar to the above-described embodiments, in the drying device 6 having this configuration, the temperature of the heat belt 121 that functions as a second heating member is set higher than the temperature of the heat roller 120 that functions as a first heating member. By so doing, the opposite face Pb opposite the liquid applied face Pa of the sheet P is heated at the higher temperature than the liquid applied face Pa, thereby restraining generation of back curl.

Here, the temperature control of the heat belt 121 may be performed based on the temperature of the heater 123 detected by the thermistor 127. In general, however, the temperature of the heater 123 is greatly different from the temperature of the heat belt 121, and the surface temperature of the heat belt 121 tends to be lower than the temperature of the heater 123. Therefore, as illustrated in FIG. 24, it is preferable to separately provide a temperature detector 141 that detects the temperature of the outer circumferential surface of the heat belt 121. Similarly, it is preferable to provide a temperature detector 142 that detects the temperature of the outer circumferential surface of the heat roller 120. By controlling the surface temperature of the heat belt 121 to be higher than the surface temperature of the heat roller 120 based on the temperatures detected by the temperature detectors 141 and 142, the temperature of the heat belt 121 and the temperature of the heat roller 120 are easily controlled.

Figure 25:
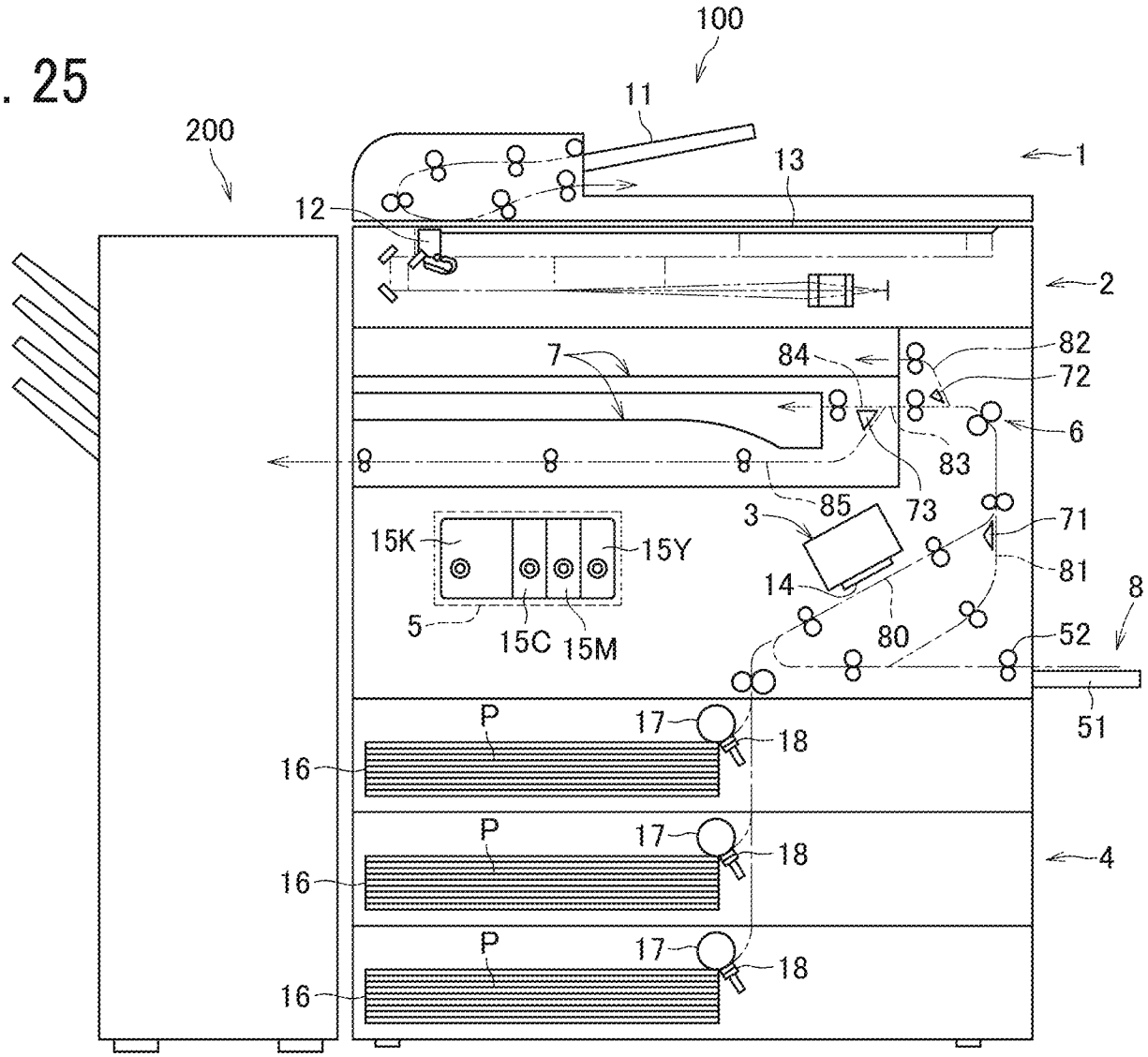
FIG. 25 is a diagram illustrating an example that the drying device according to the present disclosure is provided in another image forming apparatus.
Figure 26:
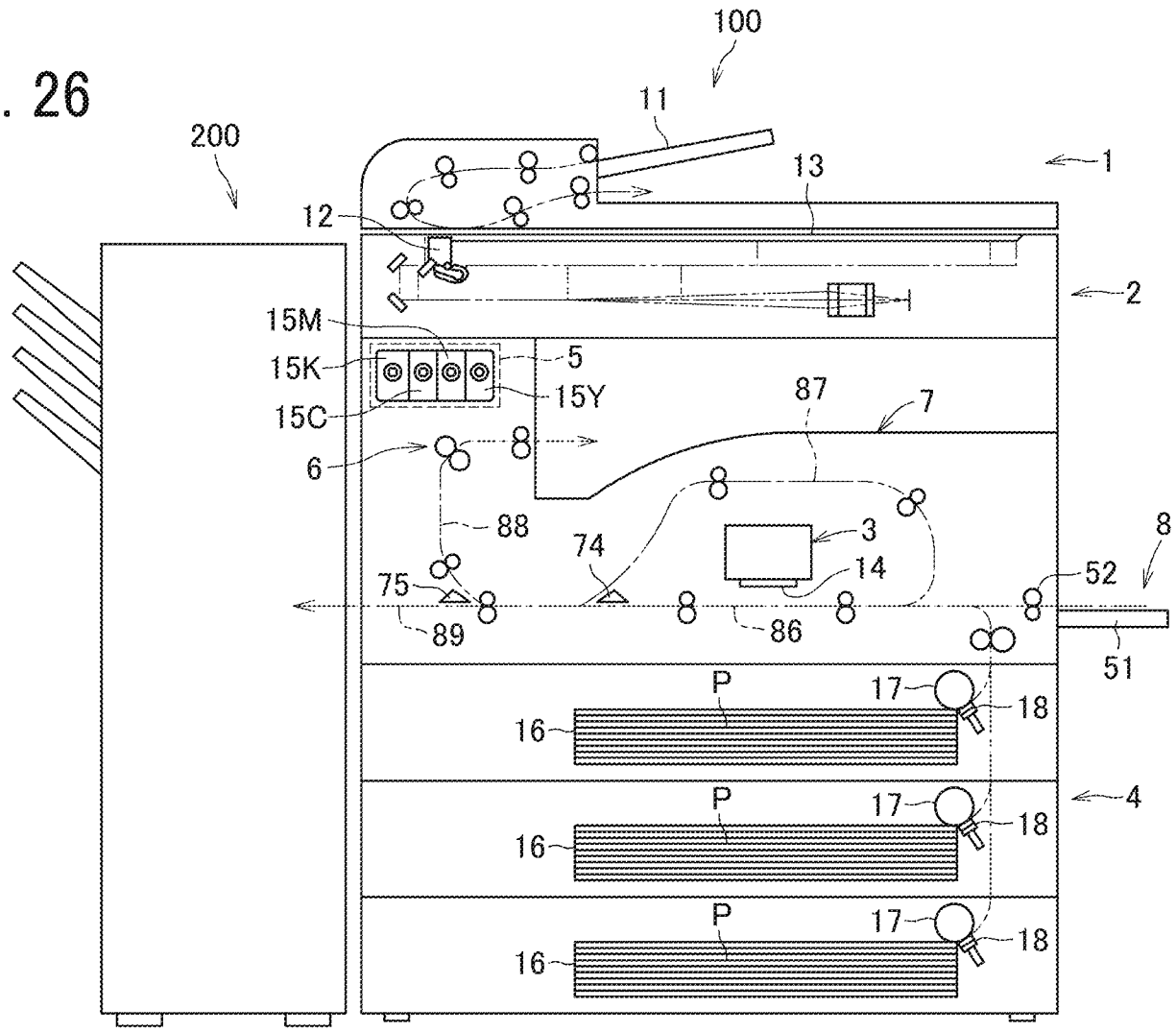
FIG. 26 is a diagram illustrating an example that the drying device according to the present disclosure is provided in yet another image forming apparatus.

Further, the drying device (heating device) according to the present disclosure is not limited to the image forming apparatus having the configuration as illustrated in FIG. 1 but may be applied, for example, to the image forming apparatus having the configuration as illustrated in FIG. 25 or FIG. 26.

Next, a description is given of the configuration of the image forming apparatus 100 with reference to FIGS. 25 and 26.

FIG. 25 is a diagram illustrating an example that the drying device according to the present disclosure is provided in another image forming apparatus 100.

FIG. 26 is a diagram illustrating an example that the drying device according to the present disclosure is provided in yet another image forming apparatus 100.

Note that the following description is given of the configuration of the image forming apparatus 100 of FIGS. 25 and 26 different from the configuration of the image forming apparatus 100 according to the above-described embodiment. That is, the description of the configuration of the image forming apparatus 100 of FIGS. 25 and 26 that is same as the configuration of the image forming apparatus 100 according to the above-described embodiment may be omitted.

Similar to the image forming apparatus 100 according to the above-described embodiments, the image forming apparatus 100 illustrated in FIG. 25 includes the original document conveying device 1, the image reading device 2, the image forming device 3, the sheet feeding device 4, the cartridge container 5, the drying device (heating device) 6, and the sheet ejection portion 7. Different from the image forming apparatus 100 according to the above-described embodiments, the image forming apparatus 100 illustrated in FIG. 25 further includes a bypass sheet feeding device 8. Different from the image forming device 3 in FIG. 1, the image forming device 3 in FIG. 25 is disposed facing a sheet conveyance passage 80 in which the sheet P is conveyed in a direction obliquely to the horizontal direction.

The bypass sheet feeding device 8 includes a bypass tray 51 and a bypass sheet feed roller 52. The bypass tray 51 functions as a sheet loader to load the sheet P. The bypass sheet feed roller 52 functions as a sheet feed body to feed the sheet P from the bypass tray 51. The bypass tray 51 is attached to open and close with respect to the housing of the image forming apparatus 100. In other words, the bypass tray 51 is rotatably attached to the housing of the image forming apparatus 100. When the bypass tray 51 is open (state in FIG. 25), the sheet P or the bundle of sheets including the sheet P is loaded on the bypass tray 51 to feed the sheet P to the housing of the image forming apparatus 100.

In the image forming apparatus 100 illustrated in FIG. 25, as a print job start instruction is issued, the sheet P is supplied from the sheet feeding device 4 or from the bypass sheet feeding device 8 and is conveyed to the image forming device 3. When the sheet P is conveyed to the image forming device 3, ink is discharged from the liquid discharge head 14 onto the sheet P to form an image on the sheet P.

When performing the duplex printing, after the sheet P has passed the image forming device 3, the sheet P is then conveyed in the opposite direction opposite the sheet conveyance direction. Then, a first passage changer 71 guides the sheet P to a sheet reverse passage 81. Then, as the sheet P passes the sheet reverse passage 81, the sheet P is reversed from the front face to the back face, and then is conveyed to the image forming device 3 again to form an image on the back face of the sheet P.

The sheet P having the image on one side or both sides is conveyed to the drying device 6 in which the ink on the sheet P is dried. Note that, when drying the ink on the front face of the sheet P and then forming an image on the back face of the sheet P, the drying device 6 may dry the ink on the front face of the sheet P first, and then, the sheet P may be conveyed in a sheet conveyance passage that detours the drying device 6. Then, the direction of conveyance of the sheet P may be switched back (changed) to the upstream side from the drying device 6 in the sheet conveyance direction, and the sheet P may be guided to the image forming device 3 again via the sheet reverse passage 81. After the sheet P has passed the drying device 6, a second passage changer 72 guides the sheet P selectively to a sheet conveyance passage 82 that runs toward the upper sheet ejection portion 7 or to a sheet conveyance passage 83 that runs to the lower sheet ejection portion 7. In a case in which the sheet P is guided to the sheet conveyance passage 82 toward the upper sheet ejection portion 7, the sheet P is ejected to the upper sheet ejection portion 7. On the other hand, when the sheet P is guided to the sheet conveyance passage 83 toward the lower sheet ejection portion 7, a third passage changer 73 guides the sheet P selectively to a sheet conveyance passage 84 toward the lower sheet ejection portion 7 or to a sheet conveyance passage 85 toward the sheet alignment apparatus 200.

Then, when the sheet P is guided to the sheet conveyance passage 84 toward the lower sheet ejection portion 7, the sheet P is ejected to the lower sheet ejection portion 7. On the other hand, when the sheet P is guided to the sheet conveyance passage 85 toward the sheet alignment apparatus 200, the sheet is conveyed to the sheet alignment apparatus 200, so that the bundle of sheets P is aligned and stacked.

Similar to the image forming apparatus 100 illustrated in FIG. 25, the image forming apparatus 100 illustrated in FIG. 26 includes the original document conveying device 1, the image reading device 2, the image forming device 3, the sheet feeding device 4, the cartridge container 5, the drying device (heating device) 6, the sheet ejection portion 7, and the bypass sheet feeding device 8. Note that, in this case, similar to the image forming device 3 in FIG. 1, the image forming device 3 in FIG. 25 is disposed facing a sheet conveyance passage 86 in which the sheet P is conveyed in the horizontal direction.

In the image forming apparatus 100 illustrated in FIG. 26, as a print job start instruction is issued, the sheet P is supplied from the sheet feeding device 4 or from the bypass sheet feeding device 8 and is conveyed to the image forming device 3. When the sheet P is conveyed to the image forming device 3, ink is discharged from the liquid discharge head 14 onto the sheet P to form an image on the sheet P.

When performing the duplex printing, after the sheet P has passed the image forming device 3, the sheet P is then conveyed in the opposite direction opposite the sheet conveyance direction. Then, a first passage changer 74 guides the sheet P to a sheet reverse passage 87. Then, as the sheet P passes the sheet reverse passage 87, the sheet P is reversed from the front face to the back face and is conveyed to the image forming device 3 again, so that an image is formed on the back face of the sheet P.

After an image is formed on one side or both sides of the sheet P, a second passage changer 75 guides the sheet P selectively to a sheet conveyance passage 88 that runs toward the drying device 6 or to a sheet conveyance passage 89 that runs to the sheet alignment apparatus 200. When the sheet P is guided to the sheet conveyance passage 88 toward the drying device 6, the drying device 6 dries the ink on the sheet P. Note that, when drying the ink on the front face of the sheet P and then forming an image on the back face of the sheet P, the drying device 6 may dry the ink on the front face of the sheet P first, and then, the sheet P may be conveyed in a sheet conveyance passage that detours the drying device 6. Then, the direction of conveyance of the sheet P may be switched back (changed) to the upstream side from the sheet conveyance passage 88 (upstream sides from the drying device 6) in the sheet conveyance direction, and the sheet P may be guided to the image forming device 3 again via the sheet reverse passage 87. Consequently, the sheet P that has passed the drying device 6 is ejected to the sheet ejection portion 7. On the other hand, when the sheet P is guided to the sheet conveyance passage 89 toward the sheet alignment apparatus 200, the sheet P is conveyed to the sheet alignment apparatus 200, so that the bundle of sheets P is aligned and stacked.

As the drying device 6 provided to the image forming apparatus 100 as illustrated in FIGS. 25 and 26, the drying device (heating device) according to the present disclosure is applied to achieve the same effect as the above-described embodiments. That is, the opposite face Pb of the sheet P that is opposite the liquid applied face Pa of the sheet P is heated at the temperature higher than the liquid applied face Pa of the sheet P, so that the deformation of the sheet P such as back curl is restrained effectively.

Further, in addition to the image forming apparatus, the drying device (heating device) according to the present disclosure may be applied to a liquid applying apparatus that applies liquid that does not form an image on a sheet.

Figure 27:
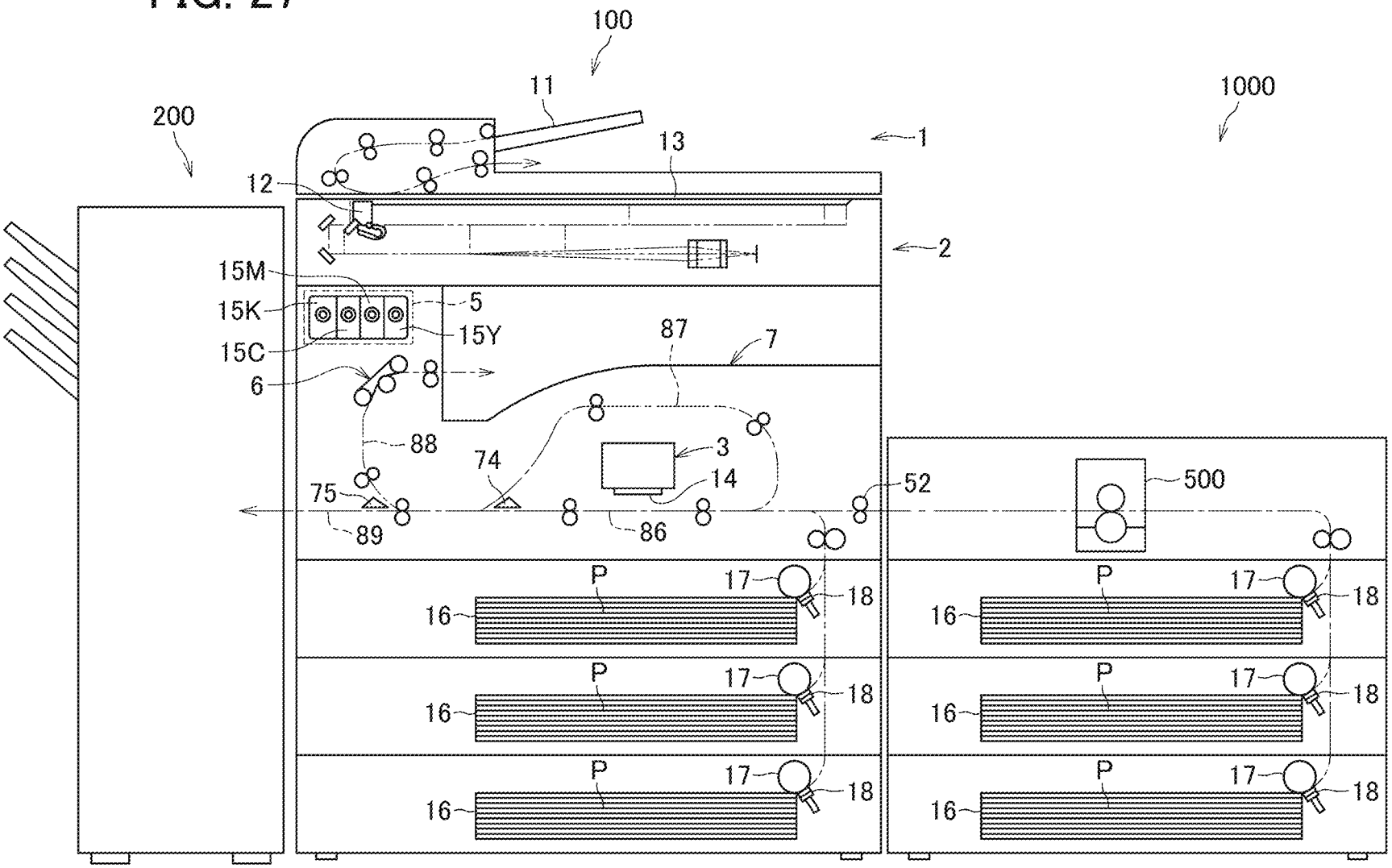
FIG. 27 is a diagram illustrating an example that the drying device according to the present disclosure is provided in a liquid applying apparatus.

For example, FIG. 27 is a diagram illustrating an example that the drying device 6 according to the present disclosure is provided in a liquid applying apparatus 1000.

That is, the drying device (heating device) according to the present disclosure may be applied to the liquid applying apparatus 1000. The liquid applying apparatus 1000 includes an inkjet image forming apparatus 100 that discharges ink to form an image on the sheet and a processing liquid applier 500 that discharges or applies a processing liquid on the surface of the sheet, as illustrated in FIG. 27, for the purpose of modifying and enhancing the surface of the sheet. Note that the processing liquid applier 500 illustrated in FIG. 27 applies a processing liquid onto the surface of the sheet P, then the liquid discharge head 14 discharges ink to apply the ink on the surface of the sheet P, and the drying device 6 dries the sheet P. However, the operation flow is not limited to the above-described flow. For example, the processing liquid applier 500 may apply a processing liquid onto the surface of the sheet P, then the drying device 6 may dry the sheet P, and the sheet may be conveyed to the sheet feed roller 52.

Figure 28:
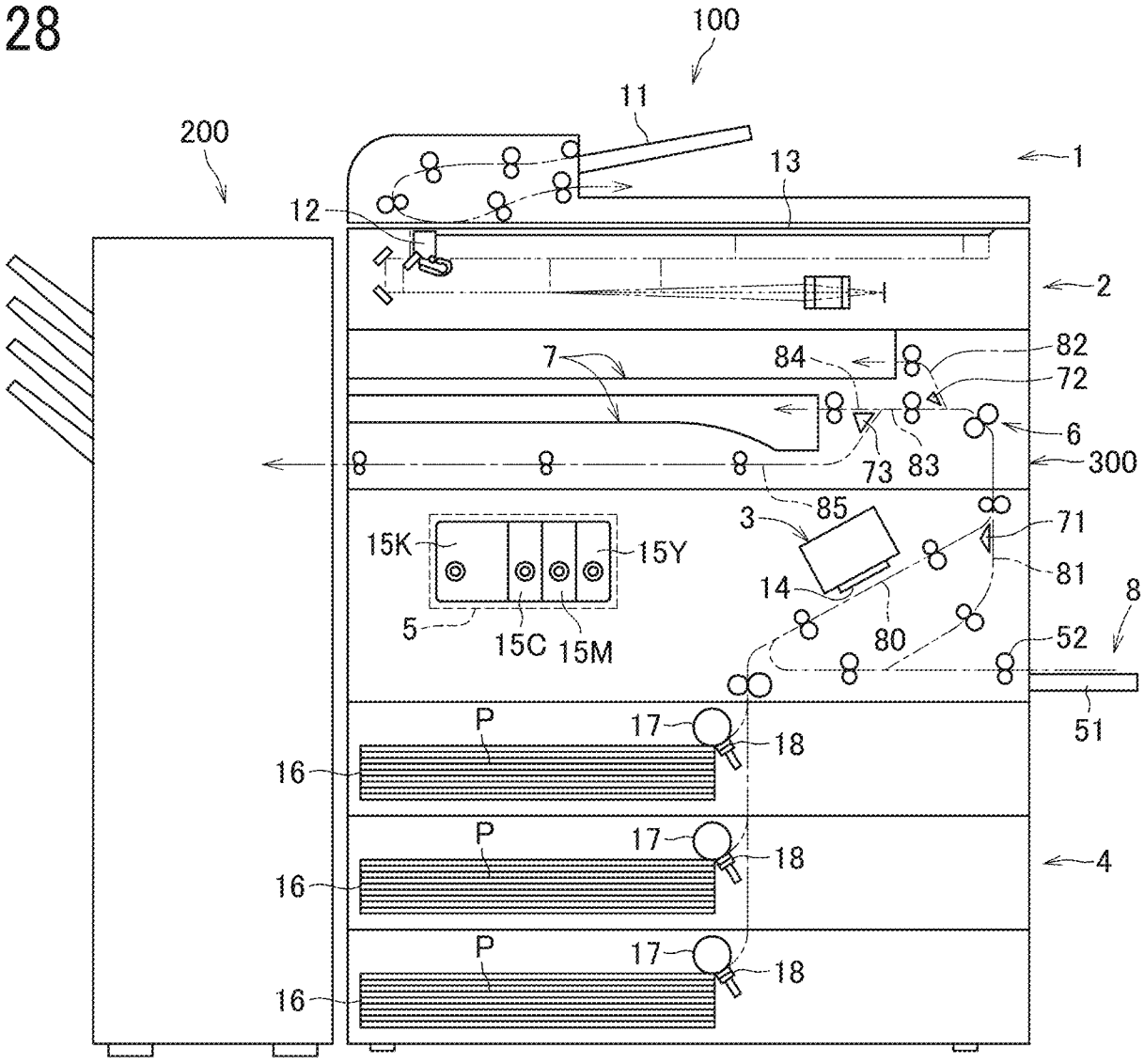
FIG. 28 is a diagram illustrating an example that the drying device according to the present disclosure is provided in a conveying device.

FIG. 28 is a diagram illustrating an example that the drying device according to the present disclosure is provided in a conveying device.

The drying device (heating device) according to the present disclosure may be applied to a conveying device 300 illustrated in FIG. 28. The conveying device 300 is detachably attached to the image forming apparatus 100. The conveying device 300 includes the sheet conveyance passages 82 to 85 through which the sheet passes, the drying device 6 to heat the sheet, and the sheet ejection portion 7 to which the sheet is discharged. The conveying device 300 is detachably attached between the image reading device 2 and the image forming device 3. Further, the conveying device 300 conveys the sheet to a post-processing device (for example, the sheet alignment apparatus 200) that performs a certain process to the sheet that has passed the drying device 6. By providing the drying device (heating device) according to the present disclosure to the conveying device 300 that is detachably attached to the image forming apparatus 100, even if deformation of the sheet such as a curl occurs in the image forming apparatus 100, the drying device 6 provided in the conveying device 300 restrains the deformation of the sheet effectively.

Figure 29:
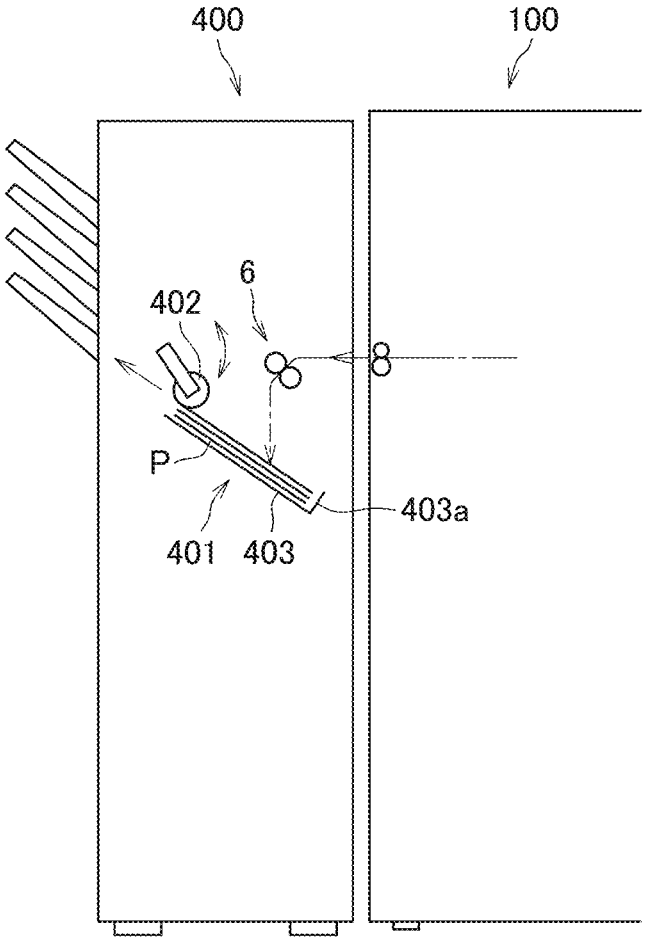
FIG. 29 is a diagram illustrating an example that the drying device according to the present disclosure is provided in a post-processing apparatus.

FIG. 29 is a diagram illustrating an example that the drying device according to the present disclosure is provided in a post-processing apparatus.

The drying device (heating device) according to the present disclosure may be applied to a post-processing apparatus 400 as illustrated in FIG. 29. The post-processing apparatus 400 includes the drying device 6 that heats the sheet and a post-processing device 401 that performs a stapling process and a punching process to the sheet.

As the sheet is conveyed from the image forming apparatus 100 to the post-processing apparatus 400 illustrated in FIG. 29, the sheet is heated by the drying device 6 and is loaded on a sheet stacking tray 403 of the post-processing device 401. At this time, in a case in which the sheet is stacked in the sheet stacking tray 403 with the face up (with the image forming surface facing up), the order of image formation may be set to be reversed, in other words, the image may be formed from the last page first. Further, the sheet P stacked on the sheet stacking tray 403 is conveyed by the sheet conveying roller 402 provided in the post-processing device 401 in the reverse direction with the trailing end to the leading end. By so doing, the trailing end of the sheet P contacts a trailing end regulator 403*a* of the sheet stacking tray 403, so that the position of the trailing end of the sheet P is aligned. Further, in order not to hinder ejection of the sheet to the sheet stacking tray 403, the sheet conveying roller 402 is disposed to be movable from a position at which the sheet conveying roller 402 contacts the sheet P to a retreat position at which the sheet conveying roller 402 does not contact the sheet P. In the state in which the position of the trailing end of the sheet P is aligned, the stapling process and the punching process are performed to the sheet P. Thereafter, the sheet conveying roller 402 rotates in the reverse direction, and therefore the sheet P on the sheet stacking tray 403 is ejected to the outside of the post-processing apparatus 400. As the drying device (heating device) according to the present disclosure is provided to the post-processing apparatus 400 described above, even if the image forming apparatus 100 generates deformation of the sheet such as a curl, the drying device 6 provided in the post-processing apparatus 400 restrains the deformation of the sheet effectively.

Further, the sheet to be heated by the drying device (heating device) according to the present disclosure may be a cut paper that is previously cut in the predetermined size in the sheet conveyance direction or a sheet roll that is a longitudinal-length sheet wound in a roll shape. However, in a case of the sheet roll, the sheet is generally conveyed while being stretched by the sheet conveying rollers disposed at intervals in the sheet conveyance direction. Therefore, even when a force to generate deformation of the sheet, such as a curl, is applied in the middle of conveyance, the sheet is conveyed while restraining the deformation of the sheet to some extent by the tension applied to the sheet. By contrast, in a case of a cut sheet, the sheet is not conveyed while being stretched by the sheet conveying roller. Therefore, in a case of a cut sheet, it is likely that the conveyance failure and the insufficient drying process occur due to the deformation of the sheet such as a curl.

Accordingly, the drying device (heating device) according to the present embodiment is preferable to the image forming apparatus particularly using cut sheets. In particular, at least one of the first heating member and the second heating member is a belt, even if the sheet is a cut sheet, the drying device (heating device) according to the present disclosure applies a decurling force to the sheet while the sheet contacts the belt (heat belt) to be effectively heated. Therefore, deformation of the sheet is restrained effectively.

Accordingly, the drying device (heating device) according to the present embodiment is preferable to the image forming apparatus using, in particular, cut sheets. However, the present disclosure does not exclude application of an image forming apparatus using a sheet roll. By providing the drying device (heating device) according to the present disclosure to the image forming apparatus using the sheet roll, deformation of the sheet such as back curl and cockling is restrained effectively.

Further, the sheet to be heated by the drying device (heating device) according to the present disclosure may be paper or any other material. As long as the sheet has flexibility and is conveyable while being warped, the sheet may be paper sheet, resin, metal, cloth, or leather.

The present disclosure is not limited to specific embodiments described above, and numerous additional modifications and variations are possible in light of the teachings within the technical scope of the appended claims. It is therefore to be understood that, the disclosure of this patent specification may be practiced otherwise by those skilled in the art than as specifically described herein, and such, modifications, alternatives are within the technical scope of the appended claims. Such embodiments and variations thereof are included in the scope and gist of the embodiments of the present disclosure and are included in the embodiments described in claims and the equivalent scope thereof.

The effects described in the embodiments of this disclosure are listed as the examples of preferable effects derived from this disclosure, and therefore are not intended to limit to the embodiments of this disclosure.

The embodiments described above are presented as an example to implement this disclosure. The embodiments described above are not intended to limit the scope of the invention. These novel embodiments can be implemented in various other forms, and various omissions, replacements, or changes can be made without departing from the gist of the invention. These embodiments and their variations are included in the scope and gist of this disclosure and are included in the scope of the invention recited in the claims and its equivalent.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. A heating device comprising:

a first heater configured to heat a sheet on a liquid applied face of the sheet; and a second heater configured to heat the sheet on an opposite face which is opposite the liquid applied face of the sheet, a temperature of the second heater to heat the sheet being higher than a temperature of the first heater to heat the sheet, wherein the first heater and the second heater are the only heaters to heat the sheet which has the liquid applied face, and wherein back curl of the sheet is prevented due to the temperature of the second heater being higher than the temperature of the first heater.

2. The heating device according to claim 1, wherein the first heater and the second heater are disposed to convey the sheet while holding the sheet between the first heater and the second heater.

3. The heating device according to claim 1, wherein the first heater is a heat rotator inside which a heat source is disposed, and wherein the second heater is a heat rotator inside which another heat source is disposed.

4. The heating device according to claim 1, further comprising a plurality of belt supports, wherein the second heater is an endless belt rotatably wound around the plurality of belt supports.

5. The heating device according to claim 4, further comprising a presser to press an outer circumferential surface of the belt between the plurality of belt supports.

6. The heating device according to claim 4, wherein the first heater and each of the plurality of belt supports are spaced away from each other in a conveyance direction of the sheet and are in contact with the belt separately.

7. The heating device according to claim 1, wherein at least one of the temperature of the first heater to heat the sheet and the temperature of the second heater to heat the sheet is adjustable according to an amount of ink application to the sheet.

8. The heating device according to claim 1, wherein a difference between the temperature of the first heater to heat the sheet and the temperature of the second heater to heat the sheet is smaller with a smaller amount of ink application to the sheet than with a larger amount of ink application to the sheet.

9. A liquid applying apparatus comprising:

a liquid applier configured to apply liquid to a sheet; and the heating device according to claim 1.

10. An image forming apparatus comprising:

an image forming device configured to form an image on a sheet with liquid; and the heating device according to claim 1.

11. A post-processing apparatus comprising:

the heating device according to claim 1; and a post-processing device configured to perform a post-processing operation to a sheet that has passed the heating device.

12. A conveying device comprising:

the heating device according to claim 1; and a conveyance passage configured to convey a sheet that has passed the heating device, to a post-processing device configured to perform a post-processing operation to the sheet.

13. The heating device according to claim 1, wherein:

the first heater and the second heater are directly opposite each other and simultaneously heat a portion of the liquid applied face of the sheet and a portion of the opposite face of the sheet which are directly opposite to each other.

14. The heating device according to claim 1, wherein:

the second heater heats the opposite face to a temperature higher a temperature than a temperature the first heater heats the liquid applied face.

15. The heating device according to claim 1, wherein:

every heater that heats the opposite face of the sheet heats the sheet to a lower temperature than every heater that heats the liquid applied face of the sheet.

16. A heating device comprising:

a first means for heating a sheet on a liquid applied face of the sheet; and a second means for heating the sheet on an opposite face opposite the liquid applied face of the sheet, a temperature of the second means for heating the sheet being higher than a temperature of the first means for heating the sheet so that the opposite face is heated to a higher temperature than the liquid applied face is heated, wherein the first means for heating and the second means for heating are the only means for heating the sheet which has the liquid applied face, and wherein back curl of the sheet is prevented due to the temperature of the second means for heating being higher than the temperature of the first means for heating.

17. The heating device according to claim 16, wherein:

the first means for heating and the second means for heating are to convey the sheet while holding the sheet between the first means for heating and the second means for heating.

18. The heating device according to claim 16, wherein:

the first means for heating and the second means for heating are directly opposite each other and simultaneously heat a portion of the liquid applied face of the sheet and a portion of the opposite face of the sheet which are directly opposite to each other.

19. The heating device according to claim 16, wherein:

every means for heating that heats the opposite face of the sheet heats the sheet to a lower temperature than every means for heating that heats the liquid applied face of the sheet.

* * * * *